US009234295B2

(12) United States Patent
Sato et al.

(10) Patent No.: US 9,234,295 B2
(45) Date of Patent: Jan. 12, 2016

(54) METHOD FOR FORMING OXIDATION RESISTANT COATING LAYER

(75) Inventors: Akihiro Sato, Tokyo (JP); Yoshihiro Tsuda, Tokyo (JP); Hiroaki Iwata, Tokyo (JP); Akira Tateno, Tokyo (JP); Hiroki Yoshizawa, Tokyo (JP); Tetsuji Hirato, Otsu (JP)

(73) Assignee: IHI CORPORATION (JP)

( * ) Notice: Subject to any disclaimer, the term of this patent is extended or adjusted under 35 U.S.C. 154(b) by 375 days.

(21) Appl. No.: 13/637,167

(22) PCT Filed: Mar. 23, 2011

(86) PCT No.: PCT/JP2011/057054

§ 371 (c)(1),
(2), (4) Date: Sep. 25, 2012

(87) PCT Pub. No.: WO2011/118663

PCT Pub. Date: Sep. 29, 2011

(65) Prior Publication Data

US 2013/0008799 A1 Jan. 10, 2013

(30) Foreign Application Priority Data

Mar. 25, 2010 (JP) ..... 2010-070244

(51) Int. Cl.
*C25D 5/50* (2006.01)
*C25D 3/44* (2006.01)

(52) U.S. Cl.
CPC ... *C25D 5/50* (2013.01); *C25D 3/44* (2013.01)

(58) Field of Classification Search
CPC ..... C25D 5/50; C25D 3/44; C23C 10/48; C23C 28/00–28/021
USPC ..... 205/224, 227
See application file for complete search history.

(56) References Cited

U.S. PATENT DOCUMENTS

2005/0153161 A1* 7/2005 Narita et al. ..... 428/652
2009/0301886 A1* 12/2009 Hoshi et al. ..... 205/50

FOREIGN PATENT DOCUMENTS

| | | | |
|---|---|---|---|
| CN | 1826456 | A | 8/2006 |
| CN | 101519274 | A | 9/2009 |
| CN | 101638788 | A | 2/2010 |
| JP | 2003-253472 | | 9/2003 |
| JP | 2003-277858 | | 10/2003 |
| JP | 2004-346373 | | 12/2004 |

(Continued)

OTHER PUBLICATIONS

International Search Report dated May 24, 2011 issued in corresponding international patent application No. PCT/JP2011/057054.

(Continued)

*Primary Examiner* — James Lin
*Assistant Examiner* — Ho-Sung Chung
(74) *Attorney, Agent, or Firm* — Ostrolenk Faber LLP

(57) ABSTRACT

The method of forming an oxidation resistant coating layer is for forming an oxidation resistant coating layer containing aluminum on a surface layer of a member (A) formed of metallic material. The method includes a plating treatment step (S1) of plating aluminum on a surface of the member (A) in a solvent, and a heat treatment step (S2) of heat-treating the member (A) whose surface has been plated by the plating treatment step (S1).

4 Claims, 32 Drawing Sheets

(56) References Cited

FOREIGN PATENT DOCUMENTS

| | | |
|---|---|---|
| JP | 2007-067196 | 3/2007 |
| JP | 2008-31551 | 2/2008 |

OTHER PUBLICATIONS

Sudhangshu Bose, "High Temperature Coatings", United States of America, Butterworth-Heinemann, 2007, p. 71-97.

Notice of Allowance dated Nov. 26, 2013 issued in corresponding Japanese Patent Application No. 2012-507047 with English translation (6 pages).

Office Action dated Jun. 11, 2015 in corresponding Chinese Patent Application No. 201180015439.6 with English language translation of Search Report (7 pages).

Hong-xing Wang, et al., "Study on high temperature oxidation- resistance and compositional change of $Ni_2Al_3$ coating on copper surface," Journal of Material Heat Treatment, vol. 29, No. 2, Apr. 30, 2008, pp. 166-170 (includes English language Abstract on front page).

* cited by examiner

METHOD FOR FORMING OXIDATION RESISTANT COATING LAYER

CROSS REFERENCE TO RELATED APPLICATIONS

The present application is a 35 U.S.C. §371 National Phase conversion of PCT/JP2011/057054, filed Mar. 23, 2011, which claims benefit of Japanese Application No. 2010-070244, filed Mar. 25, 2010, the disclosure of which is incorporated herein by reference. The PCT International Application was published in the Japanese language.

TECHNICAL FIELD

The present invention relates to a method of forming an oxidation resistant coating layer.

BACKGROUND ART

In the related art, a majority of members such as turbine blades that are used in a high-temperature environment are formed of metallic material such as nickel-based alloy or titanium-based alloy that is heat resistant material.

Furthermore, in recent years, a technology of improving the oxidation resistant characteristics of the members by forming an oxidation resistant coating layer on a surface layer of the members has been generally used.

In the technology of forming this oxidation resistant coating layer, the surface layer of a member is enriched with aluminum (the content of aluminum is increased) and this surface layer is used as the oxidation resistant layer to form the oxidation resistant coating layer.

Specific examples of a method of enriching the surface layer of the member with aluminum include a method of diffusing aluminum in the surface layer of the member, a method of thermally spraying an alloy containing a large amount of aluminum, a method of forming a film of an alloy containing a large amount of aluminum using sputtering, a plating process using molten salt or molten aluminum, and the like.

According to the method of diffusing aluminum in the surface layer of the member, aluminum is diffused in the surface layer of the member by vapor phase reaction of aluminum halide and thus an aluminum-rich oxidation resistant layer is formed.

According to the method of thermally spraying an alloy containing a large amount of aluminum, an alloy containing a large amount of aluminum is thermally sprayed to a surface of the member to make the alloy containing a large amount of aluminum be attached to the surface of the member, whereby the aluminum-rich oxidation layer is formed.

According to the method of forming a film of an alloy containing a large amount of aluminum using sputtering, an alloy containing a large amount of aluminum is deposited on the surface of the member in a manner of physical vapor deposition by using a target formed of an alloy containing a large amount of aluminum, whereby the aluminum-rich oxidation resistant layer is formed.

According to the plating process using molten salt or molten aluminum, the member is dipped in the molten aluminum, whereby the aluminum-rich oxidation layer is formed.

DOCUMENT OF RELATED ART

Non-Patent Document

[Non-Patent Document 1] Sudhangshu Bose, "High Temperature Coatings", United States of America, Butterworth-Heinemann, 2007, p. 71-97

SUMMARY OF INVENTION

Technical Problem

However, in the method of diffusing aluminum, it is difficult to treat the vapor phase chloride or fluoride. In addition, to control a high-temperature vapor phase reaction, a large amount of auxiliary materials may be necessary (a pack method), or a large-scaled apparatus may be necessary (a VPA method, a CVD method). Furthermore, in the method of diffusing aluminum, a batch-type is generally used, and thus it is difficult to continuously carry out the process.

In the method of thermally spraying an alloy containing a large amount of aluminum, it is necessary to prepare alloy powders containing a large amount of aluminum in advance, and thus the process becomes complicated. In addition, in a case where the member has a complicated shape, the process may become troublesome because it is necessary to control the position of the member in a complicated manner, or a portion of the member onto which the alloy is not thermally sprayed may be present in a surface thereof. Furthermore, the oxidation resistant layer has a tendency to be thick, and thus adverse effects may be exerted on the mechanical characteristics that are required for the member.

In the method of forming a film of an alloy containing a large amount of aluminum using sputtering, the film forming rate is slow. Furthermore, in a case where the member has a complicated shape, the process may become troublesome because it is necessary to control the position of the member in a complicated manner, or a portion of the member on which the film of the alloy is not formed may be present in a surface thereof.

In the plating process using molten salt or molten aluminum, a high-temperature tank of 600° C. or more is necessary, and thus a scale of a facility increases. Particularly, in a case of using the molten salt, a high-temperature tank to which corrosion resistant treatment is performed is necessary, and thus the facility cost increases. In addition, in the plating process, it is difficult to control the plating thickness.

The invention was made in consideration of the above-described problems, and an object thereof is to provide a new method of forming an oxidation resistant coating layer that is different from the method of the related art.

Solution to Problem

The present invention adopts the following configurations as means for solving the above-described problems.

According to an aspect of the present invention, a method of forming an oxidation resistant coating layer is for forming an oxidation resistant coating layer containing aluminum on a surface layer of a member formed of metallic material. The method includes a plating treatment step of plating aluminum on a surface of the member in a solvent, and a heat treatment step of heat-treating the member whose surface has been plated by the plating treatment step.

In this case, in the plating treatment step, the surface of the member is plated with aluminum in the solvent, and then the heat treatment is performed, whereby the oxidation resistant coating layer is formed on the surface layer of the member.

In addition, the member on which the oxidation resistant coating layer is formed may be nickel or nickel-based alloy.

In this case, nickel-aluminum, or β-NiAl constituting an excellent oxidation resistant coating layer is formed on the surface layer of the member.

In addition, the member on which the oxidation resistant coating layer is formed may be titanium or titanium-based alloy.

In this case, titanium-aluminum is formed on the surface layer of the member.

In addition, the plating treatment step may include electroplating treatment using dimethylsulfone as the solvent.

In this case, a treatment temperature in the plating treatment step can be several hundred degrees lower than that of plating treatment using molten salt or molten aluminum in the related art. Therefore, a plated layer can be formed without using a high-temperature tank.

In addition, the temperature of the heat treatment in the heat treatment step may be 1000° C. or higher.

Effects of Invention

According to the present invention, a film forming rate can be faster than that of an aluminum alloy using sputtering in the related art, and thus the oxidation resistant coating layer can be formed in a short time.

In addition, it is not necessary to use vapor phase chloride or fluoride that is difficult to treat. In addition, a large amount of auxiliary materials or a large-scaled apparatus to control a high-temperature vapor phase reaction is not necessary.

In addition, even when the member has a complicated shape, it is not necessary to change the position of the member during film formation in a complicated manner, and a uniform and thin oxidation resistant coating can be formed on an entire surface of the member.

DESCRIPTION OF EMBODIMENTS

Hereinafter, an embodiment of a method of forming an oxidation resistant coating layer according to the present invention will be described with reference to the drawings. In addition, in the following drawings, the scale of each member is appropriately changed so as to make each member have a recognizable size.

Figure 1:
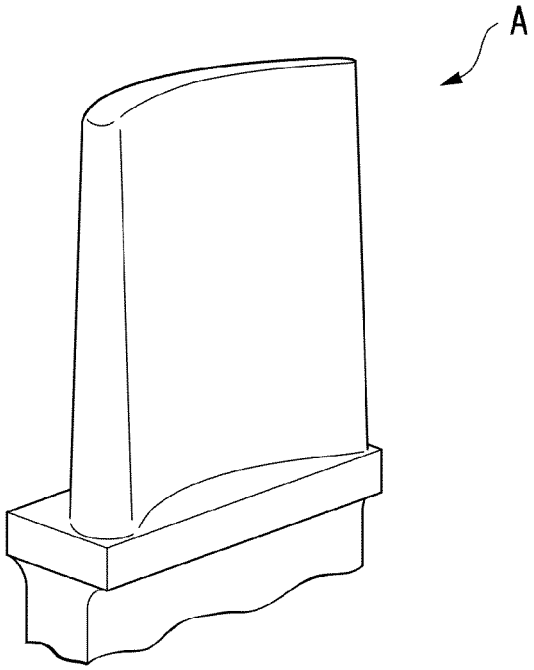
FIG. 1 is a perspective view of a turbine blade on which an oxidation resistant coating layer is formed according to an embodiment of the present invention.

FIG. 1 shows a perspective view illustrating a turbine blade A that is an example of a member on which an oxidation resistant coating layer is formed according to this embodiment.

The turbine blade A in this embodiment is formed of nickel-based alloy (metallic material) that is heat resistant material. In addition, the turbine blade A may be formed of metallic material containing nickel, nickel-based alloy, titanium, or titanium-based alloy.

Figure 2:
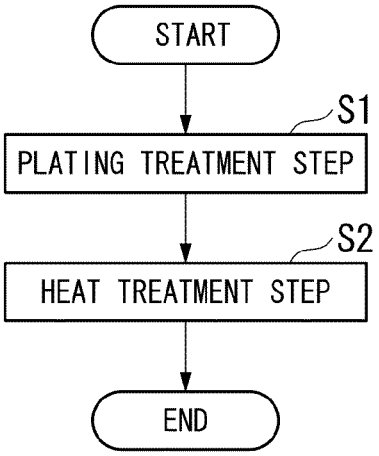
FIG. 2 is a flowchart illustrating a method of forming the oxidation resistant coating layer according to the embodiment of the present invention.

FIG. 2 shows a flowchart illustrating a method of forming the oxidation resistant coating layer according to this embodiment.

As shown in FIG. 2, the method of forming the oxidation resistant coating layer in this embodiment includes a plating treatment step S1 and a heat treatment step S2. In addition, before the plating treatment step S1, surface treatment may be performed with respect to the member on which the oxidation resistant coating layer will be formed. As the surface treatment, polishing, surface roughing treatment (for example, blasting), oxide film removing treatment (for example, anodic dissolution), and the like may be given as examples, and some of these may be performed in combination.

In the plating treatment step S1, the surface of the turbine blade A is plated with aluminum by electroplating treatment using dimethylsulfone (solvent) that is a non-aqueous solvent.

An electrodeposition apparatus 1 that carries out the plating treatment step S1 will be described with reference to FIG. 3.

Figure 3:
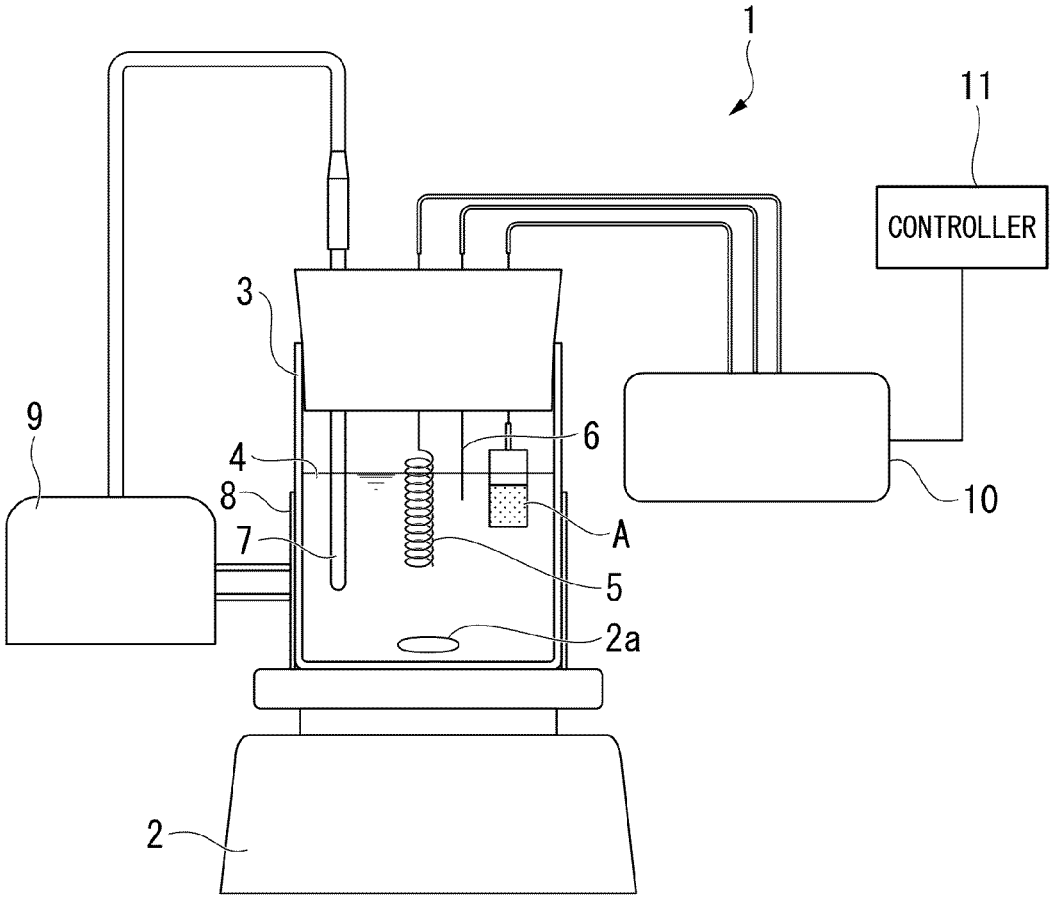
FIG. 3 is a schematic configuration diagram of an electrodeposition apparatus according to the embodiment of the present invention.

FIG. 3 shows a schematic configuration diagram of the electrodeposition apparatus 1.

As shown in FIG. 3, the electrodeposition apparatus 1 includes a hot stirrer 2, an electrodeposition tank 3, an electrolytic solution 4, a counter electrode 5, a reference electrode 6, a temperature sensor 7, a rubber heater 8, a thermostat 9, a potentio-galvanostat 10, and a controller 11.

The hot stirrer 2 stirs the electrolytic solution 4 stored in the electrodeposition tank 3 using a stirring bar 2*a* while heating the electrolytic solution 4. The electrodeposition tank 3 is a container that stores the electrolytic solution 4 at the inside thereof, and is placed on the hot stirrer 2. The electrolytic solution 4 is a solution obtained by mixing dimethylsulfone ($(CH_3)_2SO_2$) as a non-aqueous solvent and aluminum chloride ($AlCl_3$) as a solute in a molar ratio of 10:2. In addition, the mixing ratio between the dimethylsulfone ($(CH_3)_2SO_2$) and the aluminum chloride ($AlCl_3$) in the electrolytic solution 4 may be within a range from 10:1 to 10:3 as a molar ratio. The melting point of the dimethylsulfone is 109° C.

In addition, in this embodiment, the counter electrode 5 and the reference electrode 6 are formed of aluminum. The counter electrode 5, the reference electrode 6, and the turbine blade A as an operation electrode are dipped in the electrolytic solution 4.

The temperature sensor 7 is disposed so that one end thereof is dipped in the electrolytic solution 4, and measures the temperature of the electrolytic solution 4.

The rubber heater 8 covers an outer surface of the electrodeposition tank 3 and heats the electrodeposition tank 3. The thermostat 9 adjusts the temperature of the rubber heater 8 to be constant based on the measured results of the temperature sensor 7.

In addition, the electrolytic solution 4 is heated by the temperature sensor 7, the rubber heater 8, and the thermostat 9, to about 110° C. that is a temperature near the melting point of the dimethylsulfone.

The potentio-galvanostat 10 is electrically connected to the counter electrode 5, the reference electrode 6, and the turbine blade A as the operation electrode, and adjusts a current value that is applied to each of these.

The controller 11 is constructed by, for example, a personal computer. The controller 11 is capable of receiving a command from an operator, and outputs a signal based on this command to the potentio-galvanostat 10.

In the electrodeposition apparatus 1, the electrolytic solution 4 is heated while being stirred by the hot stirrer 2, the temperature sensor 7, the rubber heater 8, and the thermostat 9, and a current is applied to the counter electrode 5, the reference electrode 6, and the turbine blade A, whereby aluminum is deposited on a surface of the turbine blade A.

In addition, a current density of the current applied to the counter electrode 5, the reference electrode 6, and the turbine blade A is preferably 30 to 120 mA/cm$^2$, and the temperature of the electrolytic solution 4 is preferably 90 to 150° C.

In addition, the electrodeposition apparatus 1 can carry out the plating treatment in the air. Furthermore, the plating treatment can be carried out in an argon gas atmosphere.

When this electrodeposition apparatus 1 is used, the film thickness of a plated layer can be arbitrarily controlled by changing an amount of current-carrying with respect to the counter electrode 5, the reference electrode 6, and the turbine blade A as the operation electrode.

In addition, when the electrodeposition apparatus 1 is used, since the turbine blade A is dipped in the electrolytic solution 4 and thus aluminum is adhered to the turbine blade A, it is not necessary to change the position of the turbine blade A like a case in which a film is formed using sputtering or thermal spraying, and a uniform and thin plated layer can be formed on the entire surface of the turbine blade A.

In addition, since the dimethylsulfone having a melting point of 109° C. is used, according to the electrodeposition apparatus 1, the temperature during plating treatment can be lower than that in plating treatment in the related art (plating treatment using molten salt or molten aluminum). Therefore, a high-temperature tank for plating treatment is not necessary, and the facility can have a small scale.

In the method of forming an oxidation resistant coating layer of this embodiment, a heat treatment step S2 is carried out after the plating treatment step S1 using the electrodeposition apparatus 1.

In the heat treatment step S2, the turbine blade A to which plating is applied in the plating treatment step S1 is subjected to heat treatment, and thus aluminum adhered to the surface of the turbine blade A is diffused and penetrates into a surface layer of the turbine blade A.

In this heat treatment step S2, for example, the turbine blade A is heated at a temperature of 700° C. or more (preferably, 1,000° C. or more) for about 1 to 2 hours in a chamber filled with air. In addition, the heat treatment may be carried out for longer than the above period. In addition, the chamber may be in a vacuum state, or may have a hydrogen atmosphere or an inert gas atmosphere (for example, an argon atmosphere). As a result thereof, aluminum is diffused and penetrates into the surface layer of the turbine blade A, and thus an oxidation resistant coating layer containing aluminum is formed in the surface layer. In addition, a continuous furnace can be used in the heat treatment step S2, and thus the process can be carried out in a continuous manner.

Experimental Example 1

A first experimental example will be described with reference to FIGS. 4A to 11. FIGS. 4A to 11 show experimental data that is obtained by changing the temperature and time in the heat treatment step S2.

In addition, this experiment was carried out using a nickel plate (pure nickel plate) to which aluminum plating treatment was applied by the electrodeposition apparatus 1 and which has a thickness of 0.5 mm instead of the turbine blade A. In the electrodeposition apparatus 1, the temperature of the electrolytic solution 4 was set to 110° C., the current density was set to 80 mA/cm$^2$, and the plating treatment was carried out in an argon gas atmosphere.

FIGS. 4A, 5A, 6A, 7A, and 8 to 11 show X-ray diffraction data obtained by measuring the surface layer of the nickel plate using an X-ray diffractometer after the heat treatment step S2. In these drawings, the vertical axis represents the intensity of an X-ray and the horizontal axis represents an angle difference (2θ) between an incident direction and a diffraction direction of the X-ray. In addition, the vertical axis has no units and the unit of the horizontal axis is an angle (°). In addition, FIGS. 4B, 5B, 6B, and 7B show micrographs of the surface layer of the nickel plate after the heat treatment step S2.

Figure 4A:
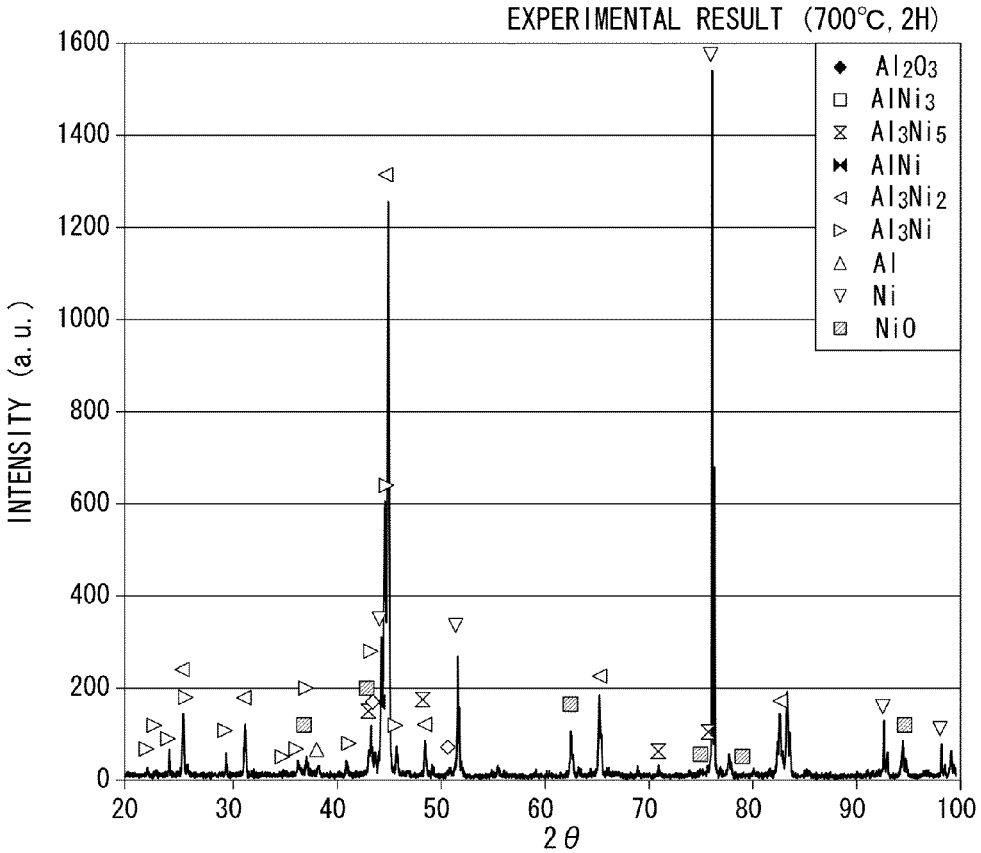
FIG. 4A is X-ray diffraction data of a surface layer of a nickel plate after a heat treatment step at a temperature of 700° C. for two hours.
Figure 4B:
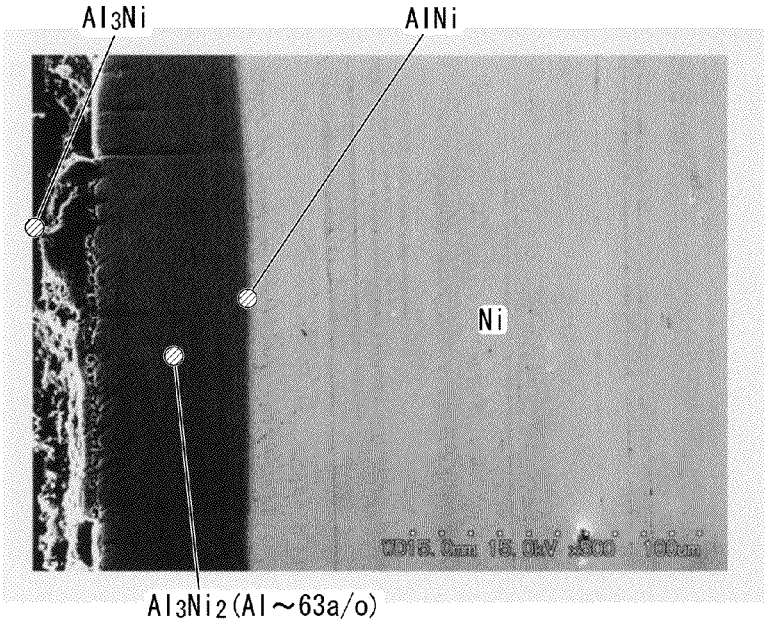
FIG. 4B is a micrograph of the surface layer of the nickel plate after the heat treatment step at a temperature of 700° C. for two hours.
Figure 5A:
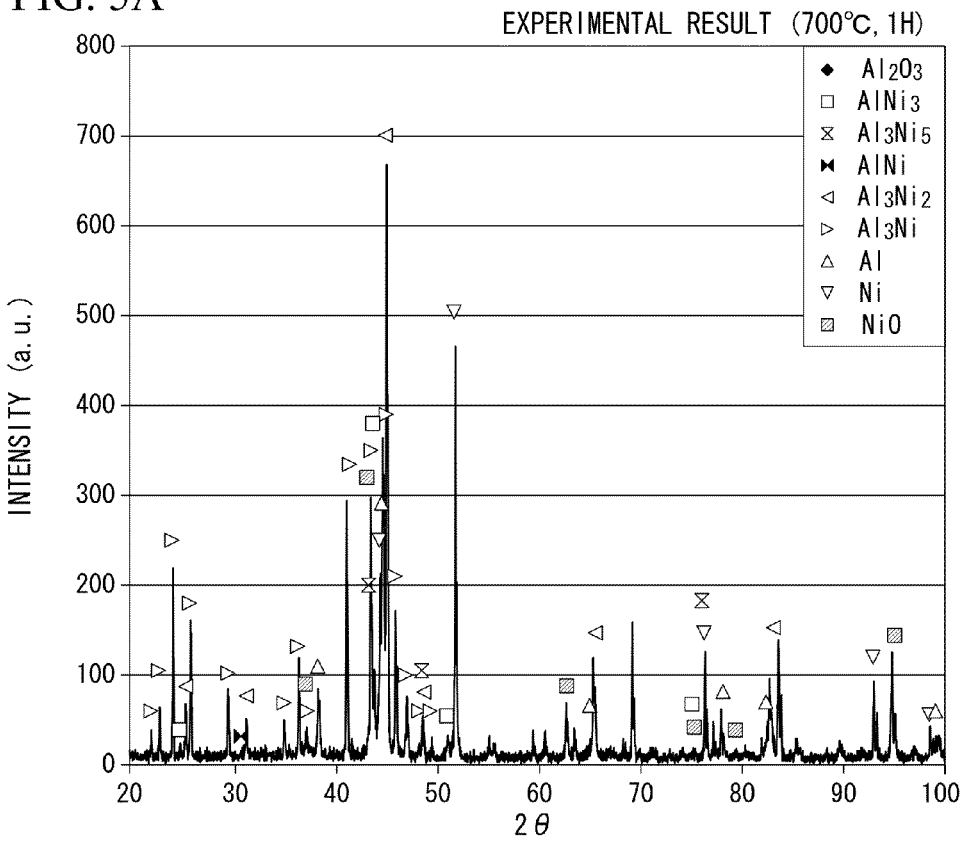
FIG. 5A is X-ray diffraction data of a surface layer of a nickel plate after a heat treatment step at a temperature of 700° C. for one hour.
Figure 5B:
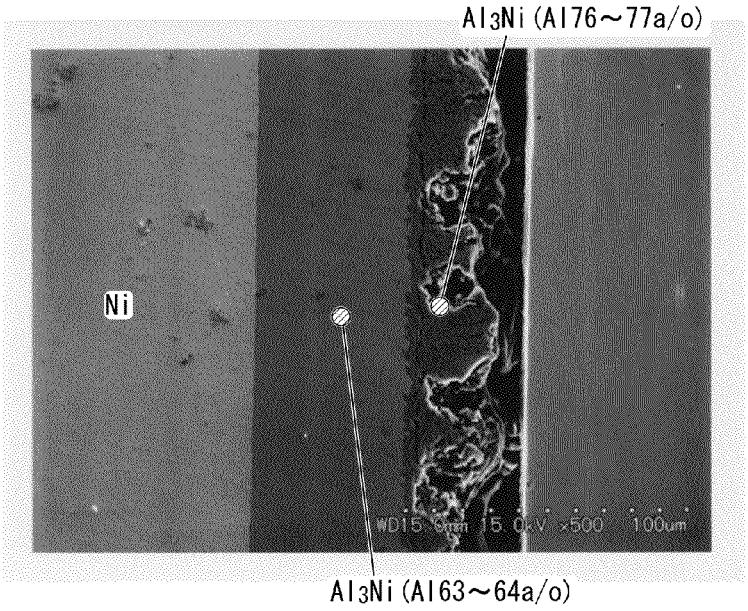
FIG. 5B is a micrograph of the surface layer of the nickel plate after the heat treatment step at a temperature of 700° C. for one hour.
Figure 6A:
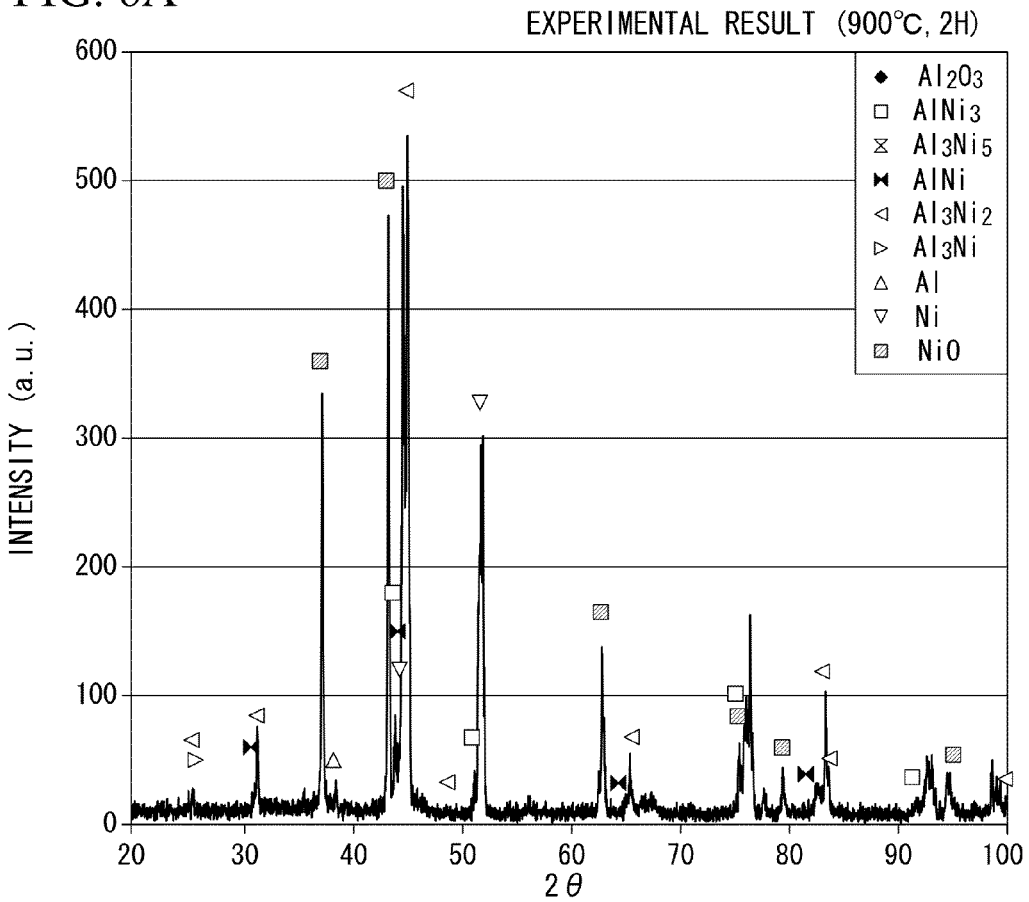
FIG. 6A is X-ray diffraction data of a surface layer of a nickel plate after a heat treatment step at a temperature of 900° C. for two hours.
Figure 6B:
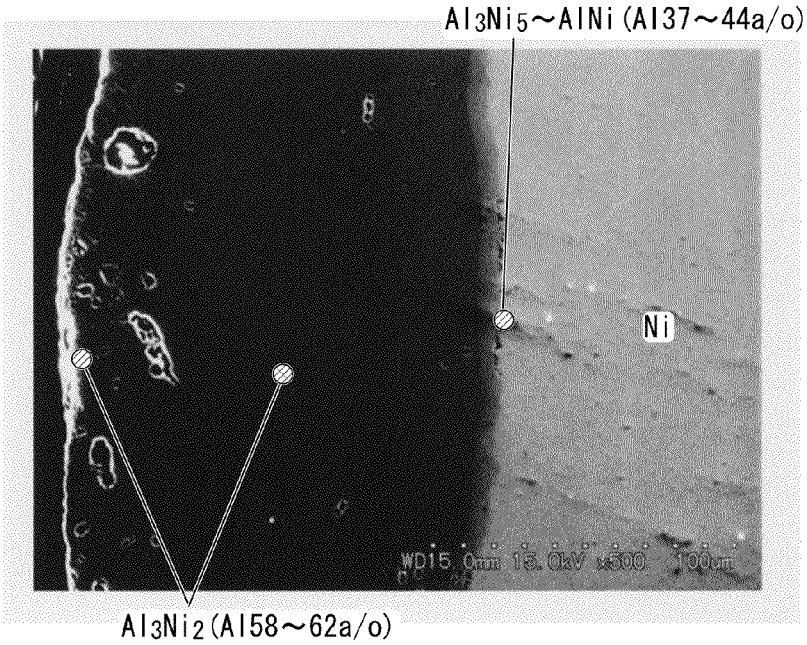
FIG. 6B is a micrograph of the surface layer of the nickel plate after the heat treatment step at a temperature of 900° C. for two hours.
Figure 7A:
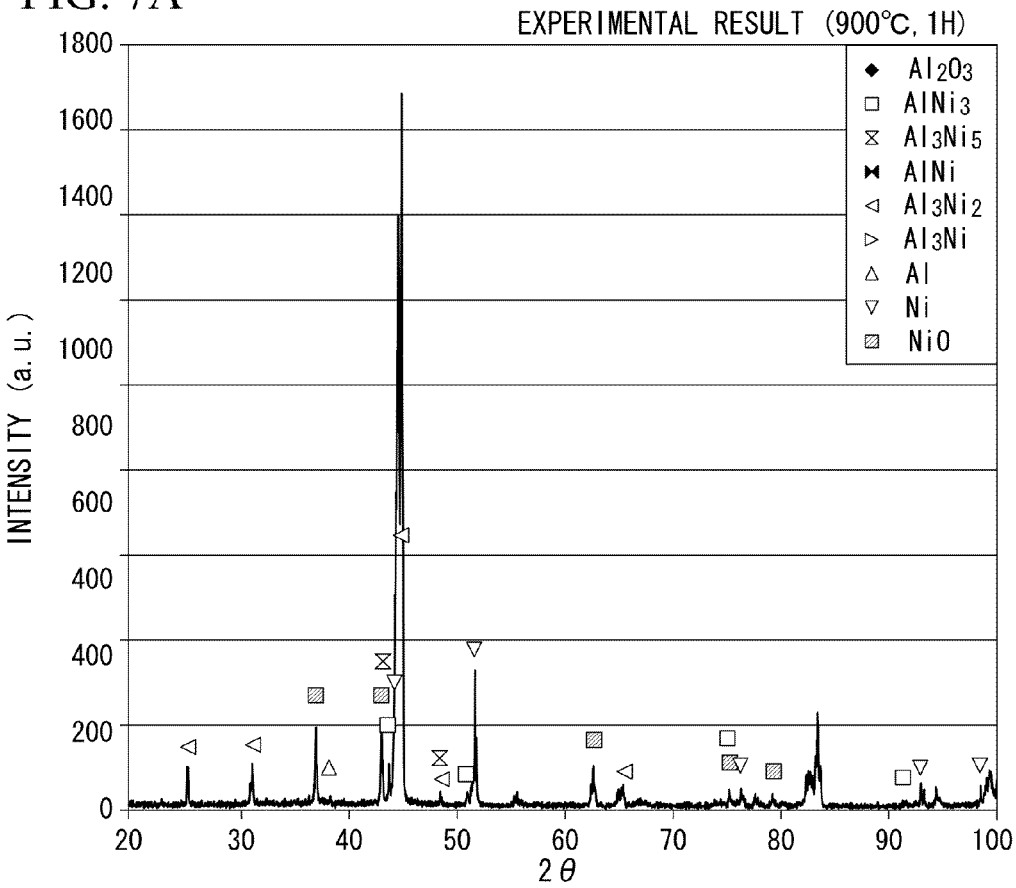
FIG. 7A is X-ray diffraction data of a surface layer of a nickel plate after a heat treatment step at a temperature of 900° C. for one hour.
Figure 7B:
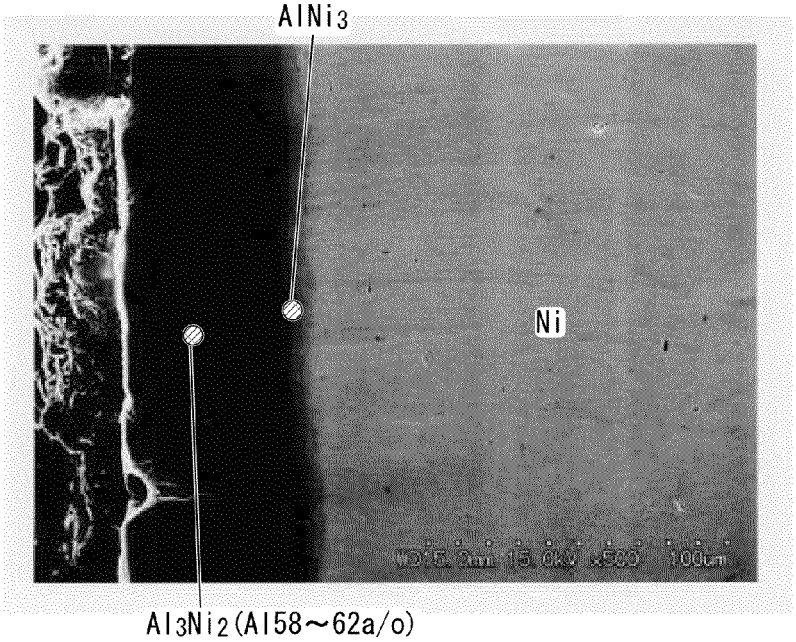
FIG. 7B is a micrograph of the surface layer of the nickel plate after the heat treatment step at a temperature of 900° C. for one hour.
Figure 8:
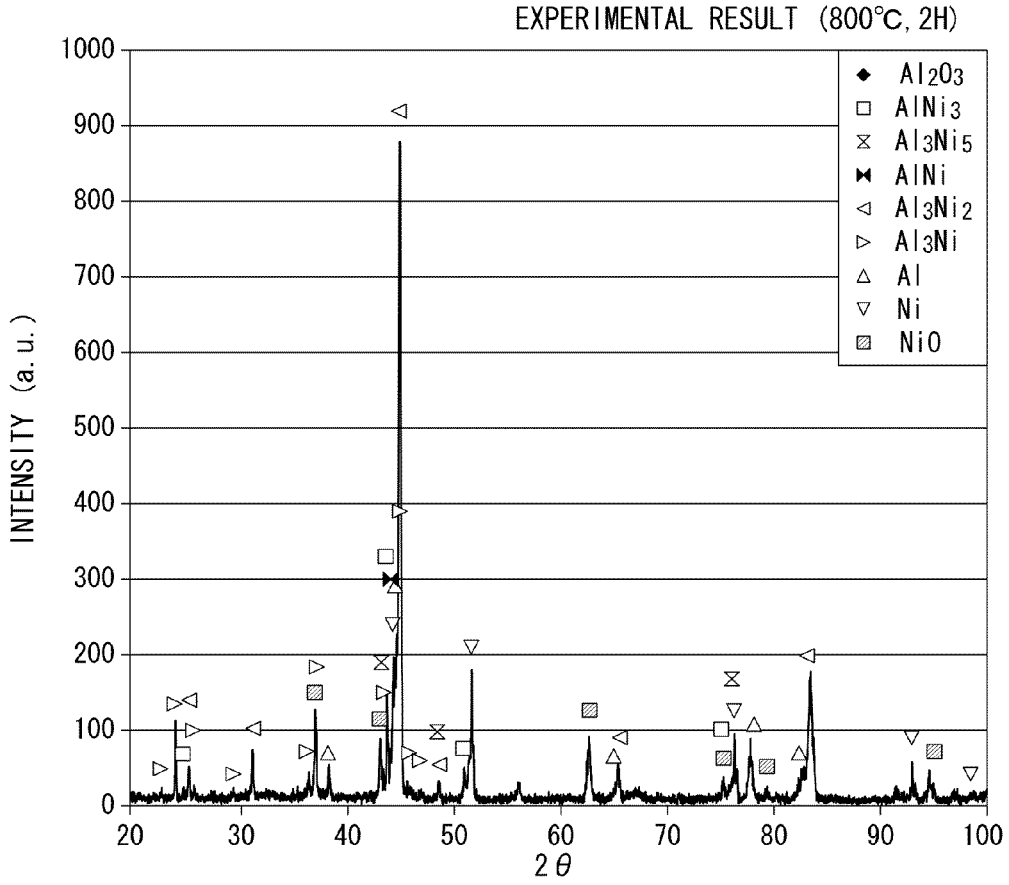
FIG. 8 is X-ray diffraction data of a surface layer of a nickel plate after a heat treatment step at a temperature of 800° C. for two hours.
Figure 9:
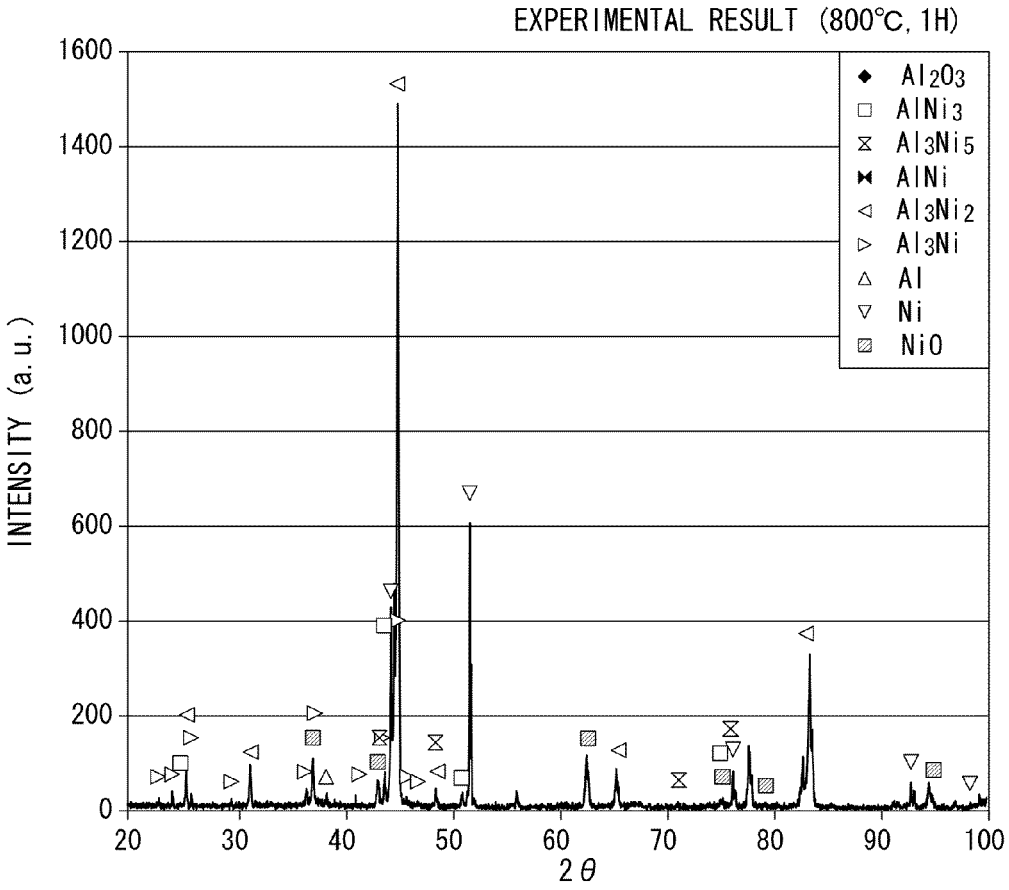
FIG. 9 is X-ray diffraction data of a surface layer of a nickel plate after a heat treatment step at a temperature of 800° C. for one hour.
Figure 10:
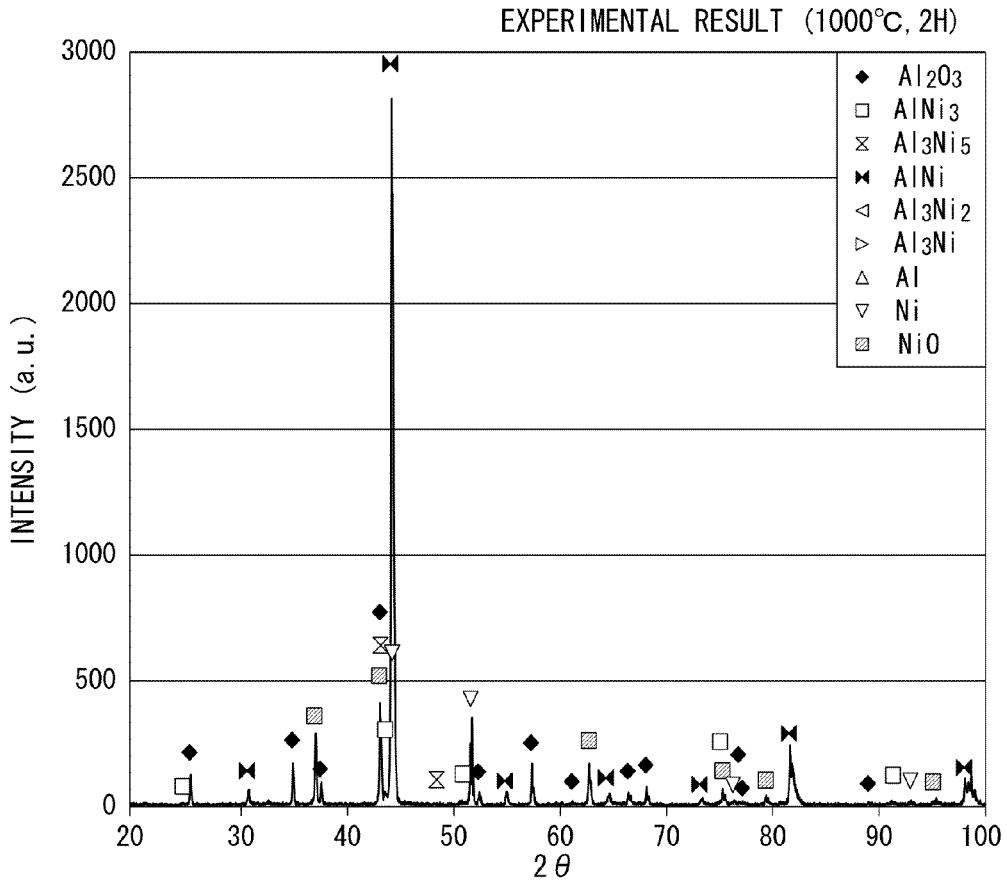
FIG. 10 is X-ray diffraction data of a surface layer of a nickel plate after a heat treatment step at a temperature of 1,000° C. for two hours.
Figure 11:
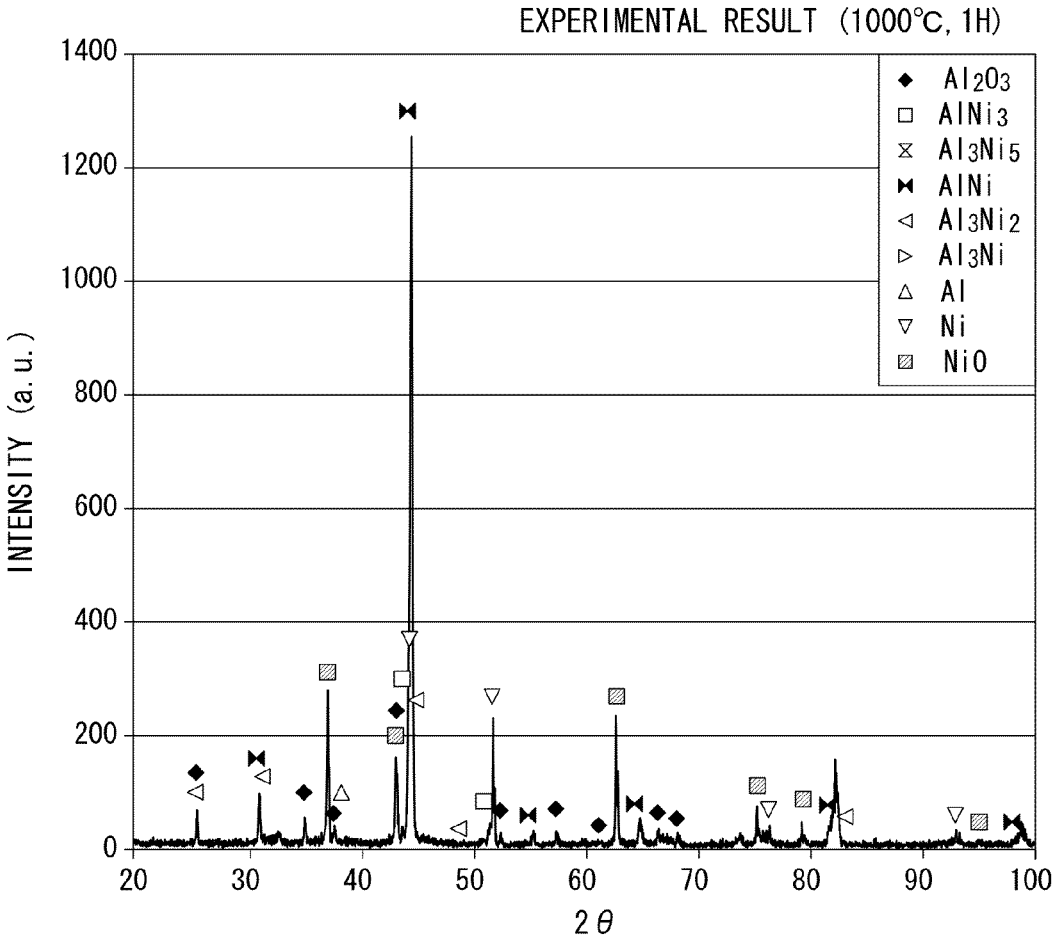
FIG. 11 is X-ray diffraction data of a surface layer of a nickel plate after a heat treatment step at a temperature of 1,000° C. for one hour.

FIGS. 4A and 4B show experimental data in a case where a temperature and a time in the heat treatment step S2 were set to 700° C. and two hours, respectively. FIGS. 5A and 5B show experimental data in a case where the temperature and the time in the heat treatment step S2 were set to 700° C. and one hour, respectively. FIGS. 6A and 6B show experimental data in a case where the temperature and the time in the heat treatment step S2 were set to 900° C. and two hours, respectively. FIGS. 7A and 7B show experimental data in a case where the temperature and the time in the heat treatment step S2 were set to 900° C. and one hour, respectively. FIG. 8 shows experimental data in a case where the temperature and the time in the heat treatment step S2 were set to 800° C. and two hours, respectively. FIG. 9 shows experimental data in a case where the temperature and the time in the heat treatment step S2 were set to 800° C. and one hour, respectively. FIG. 10 shows experimental data in a case where the temperature and the time in the heat treatment step S2 were set to 1,000° C. and two hours, respectively. FIG. 11 shows experimental data in a case where the temperature and the time in the heat treatment step S2 were set to 1,000° C. and one hour, respectively.

As shown in FIGS. 4A, 5A, 6A, 7A, and 8 to 11, when the heat treatment step S2 was carried out after the plating treatment step S1, it was confirmed that nickel-aluminum to function as an oxidation resistant layer was contained in the surface layer of the nickel plate. It was assumed that when the heat treatment step S2 was carried out, aluminum of the plated layer was diffused and penetrated into the surface layer of the nickel plate and thus nickel-aluminum that is alloy was generated. That is, when the heat treatment step S2 was carried out after the plating treatment step S1, the surface layer of the nickel plate was transformed into an oxidation resistant layer and thus the oxidation resistant coating layer was formed in the nickel plate.

In addition, as shown in FIGS. 4B, 5B, 6B, and 7B, the oxidation resistant layer, which was formed in a case where the temperature at the heat treatment step S2 was 700° C. or 900° C., was composed mainly of $Al_3Ni_2$ phase regardless of the treatment time in the heat treatment step S2. On the other hand, the oxidation resistant layer, which was formed in a case where the temperature at the heat treatment step S2 was 1,000° C. or more, was composed mainly of β-NiAl phase (AlNi) regardless of the treatment time in the heat treatment step S2.

Since the $Al_3Ni_2$ phase is more brittle than the β-NiAl phase, it is preferable that the temperature in the heat treatment step S2 is 1,000° C. or more.

Experimental Example 2

Figure 12A:
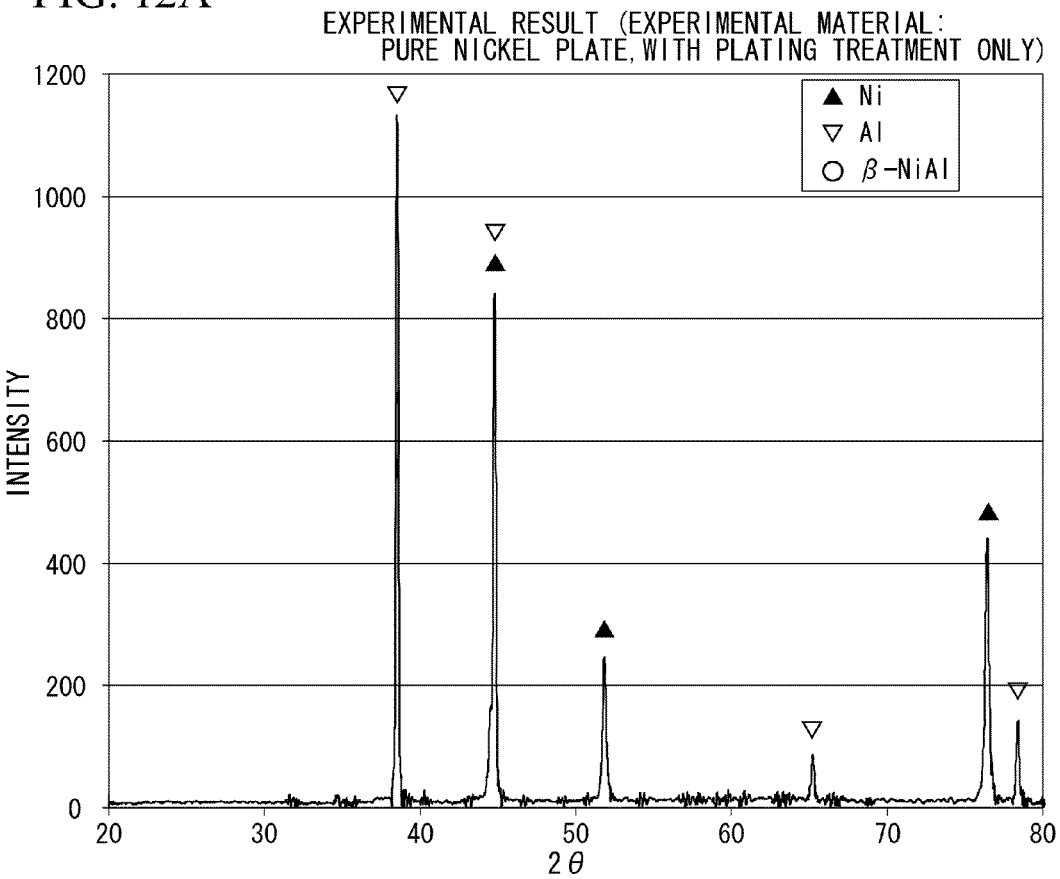
FIG. 12A is X-ray diffraction data of a surface layer of a nickel plate to which only plating treatment is performed.
Figure 13A:
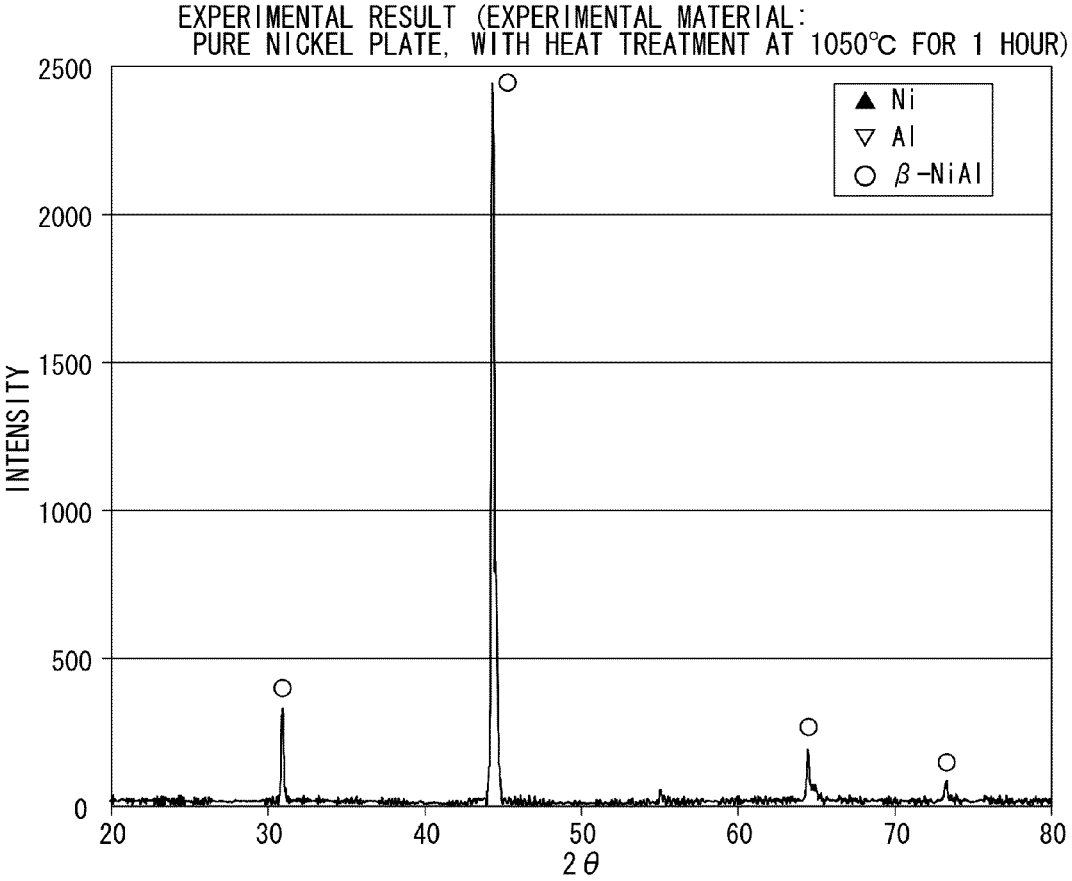
FIG. 13A is X-ray diffraction data of a surface layer of a nickel plate to which heat treatment is performed at a temperature of 1,050° C. for one hour after plating treatment.
Figure 13B:
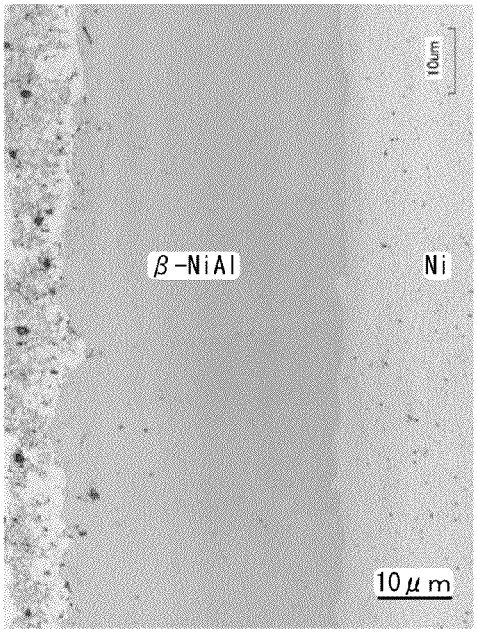
FIG. 13B is a micrograph of the surface layer of the nickel plate to which heat treatment is performed at a temperature of 1,050° C. for one hour after the plating treatment.
Figure 14A:
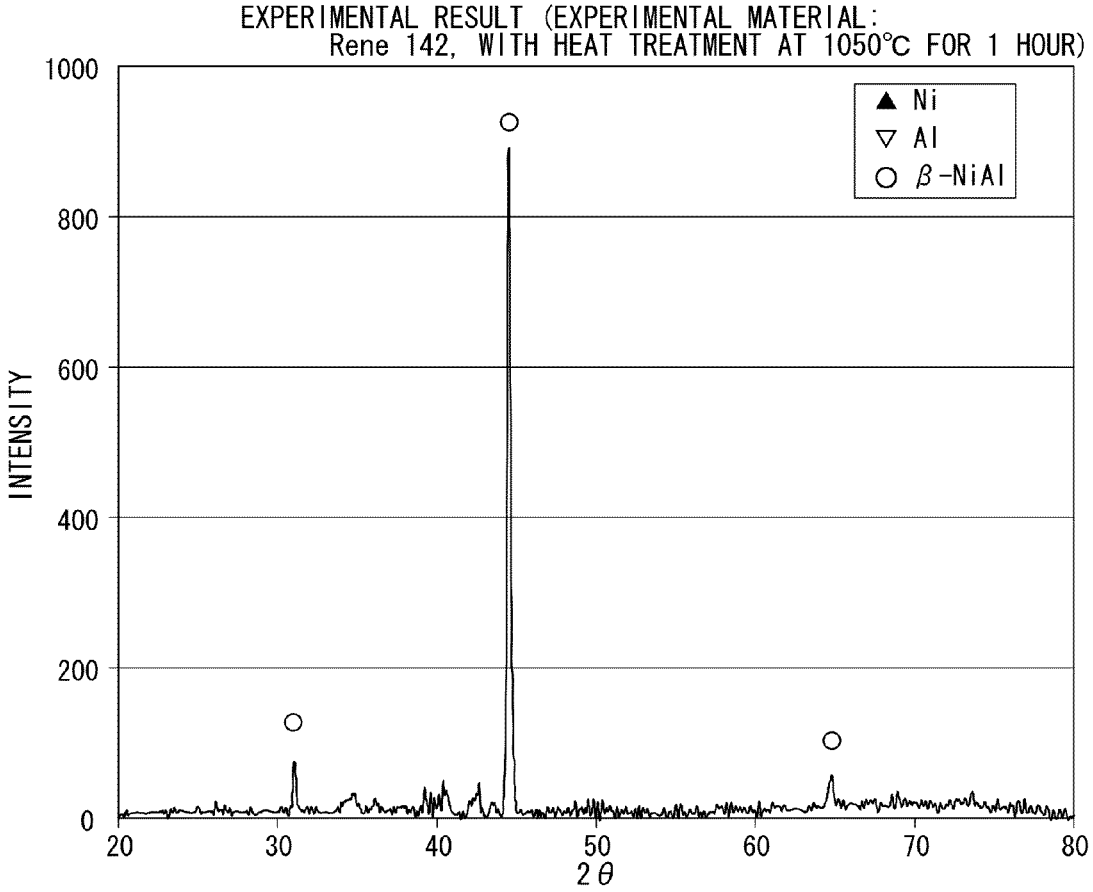
FIG. 14A is X-ray diffraction data of a surface layer of a plate material which is formed of Rene 142 and to which heat treatment is performed at a temperature of 1,050° C. for one hour after plating treatment.
Figure 14B:
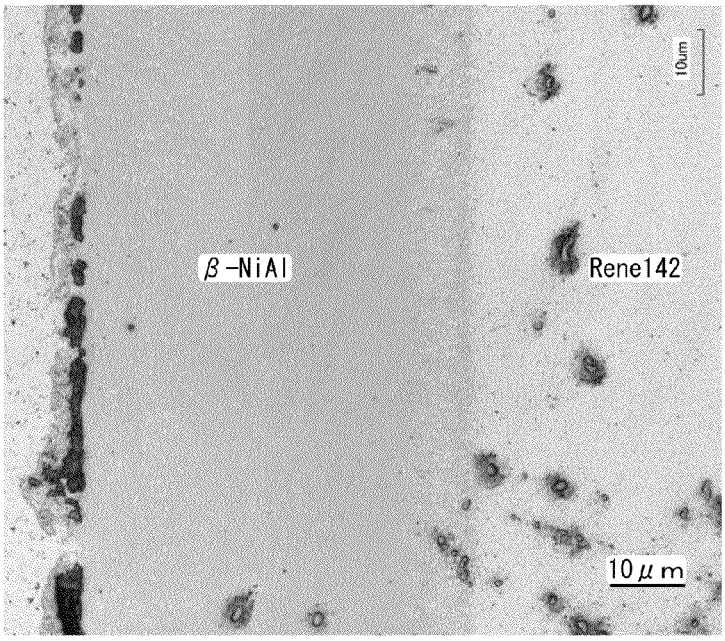
FIG. 14B is micrograph of the surface layer of the plate material which is formed of Rene 142 and to which heat treatment is performed at a temperature of 1,050° C. for one hour after the plating treatment.

A second experimental example will be described with reference to FIGS. 12A to 14B. FIGS. 12A to 14B show experimental data that is obtained with conditions different from the conditions in Experimental Example 1. FIGS. 12A, 13A, and 14A show X-ray diffraction data obtained by measuring the surface layer of an experimental material by using an X-ray diffractometer. The vertical axis represents the intensity of an X-ray and the horizontal axis represents an angle difference (2θ) between an incident direction and a diffraction direction of the X-ray. In addition, the vertical axis has no units and the unit of the horizontal axis is an angle (°). In addition, FIGS. 12B, 13B, and 14B show micrographs of the surface layer of the experimental material.

Figure 12B:
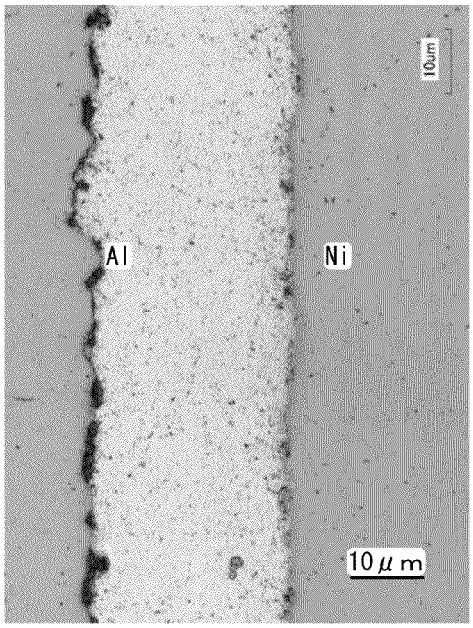
FIG. 12B is a micrograph of the surface layer of the nickel plate to which only plating treatment is performed.

FIGS. 12A and 12B show experimental data in a case where the only plating treatment step S1 was carried out with respect to a pure nickel plate as the experimental material using the electrodeposition apparatus 1. In addition, FIGS. 13A and 13B show experimental data in a case where the plating treatment step S1 was carried out with respect to a pure nickel plate as the experimental material using the electrodeposition apparatus 1 and then the heat treatment step S2 was carried out at 1050° C. for one hour. In addition, FIGS. 14A and 14B show experimental data in a case where the plating treatment step S1 was carried out with respect to a Rene 142 plate as the experimental material using the electrodeposition apparatus 1 and then the heat treatment step S2 was carried out at 1050° C. for one hour.

In addition, conditions of the plating treatment (plating treatment step S1) in this experimental example were the same as that in Experimental Example 1. In addition, the Rene 142 is nickel-based alloy containing, with % by weight, 6.8% of chromium (Cr) 12.0% of cobalt (Co), 1.5% of molybdenum (Mo), 4.9% of tungsten (W), 6.2% of aluminum (Al), 6.4% of tantalum (Ta), 2.8% of rhenium (Re), 1.5% of hafnium (Hf), 0.12% of carbon (C), 0.015% of boron (B), 0.02% of zirconium (Zr), the remainder being nickel (Ni).

As can be seen from FIGS. 12A and 12B, the β-NiAl phase having an excellent oxidation resistant function was not confirmed when the plating treatment was only carried out with respect to the pure nickel plate. Conversely, as can be seen from FIGS. 13A to 14B, when the heat treatment was carried out after the plating treatment was carried out with respect to the pure nickel or nickel-based alloy (Rene 142), the β-NiAl phase was confirmed.

That is, when the heat treatment step S2 was carried out after the plating treatment step S1, it was confirmed that the oxidation resistant coating layer was formed in the surface layer of the nickel plate (or the nickel-based alloy).

Experimental Example 3

A third experimental example will be described with reference to FIGS. 15 to 20C.

As the experimental material, the Rene 142 that was used in Experimental Example 2 was adopted. After carrying out blasting treatment (surface roughing treatment) with respect to the experimental material, the plating treatment step S1 and the heat treatment step S2 were sequentially carried out with respect to the experimental material. In the plating treatment step S1, an aluminum plated layer having a thickness of about 30 μm was formed on the surface of the experimental material. In the heat treatment step S2, heat treatment was carried out in a vacuum atmosphere (about $10^{-2}$ Pa).

Figure 15:
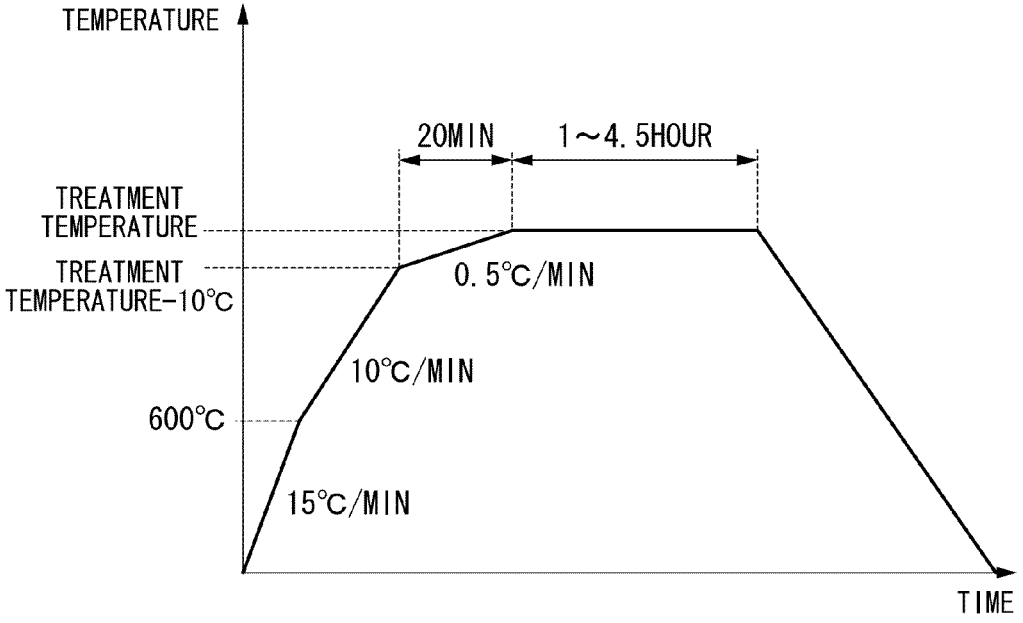
FIG. 15 is a schematic diagram illustrating temperature increase conditions with respect to an experimental material.

In the heat treatment step S2, the experimental material was heated to a predetermined treatment temperature based on temperature increase conditions shown in FIG. 15. That is, the experimental material was heated at a temperature increase rate of 15° C./min until the experimental material reached 600° C. from room temperature, at a temperature increase rate of 10° C./min until the experimental material reached [treatment temperature −10° C.] from 600° C., and at a temperature increase rate of 0.5° C./min until the experimental material reached the treatment temperature from [treatment temperature −10° C.].

Figure 16A:
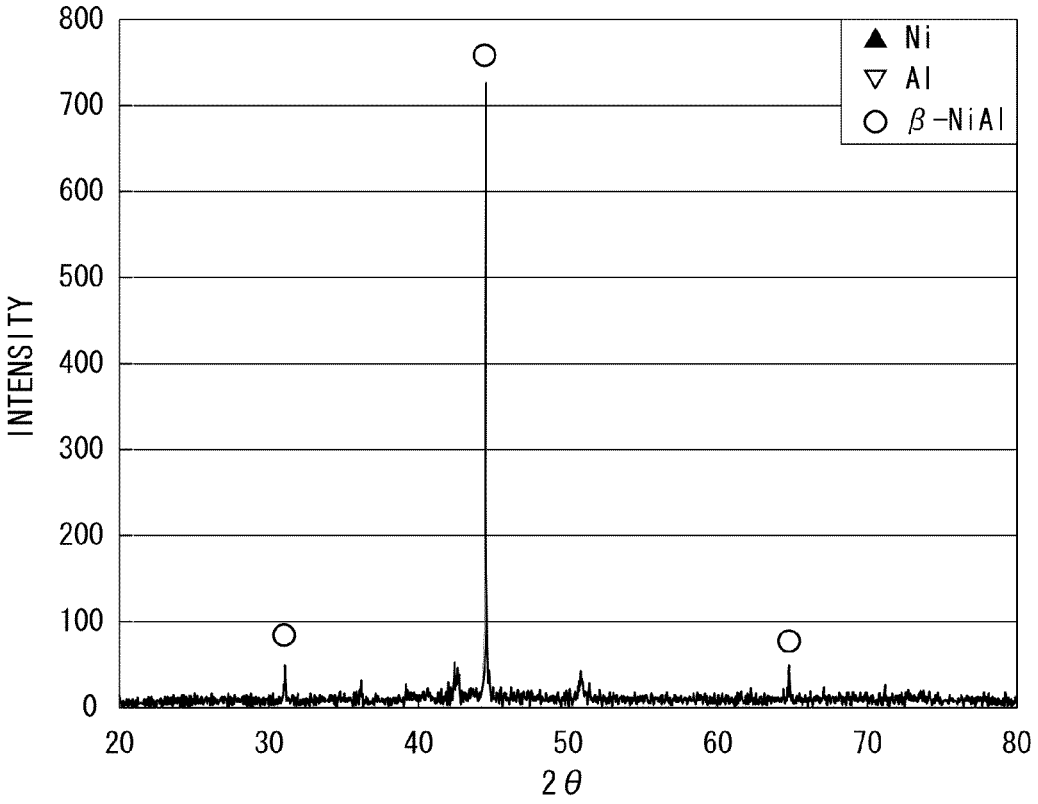
FIG. 16A is X-ray diffraction data of a surface layer of an experimental material after a heat treatment step at a temperature of 1,000° C. for one hour.
Figure 16B:
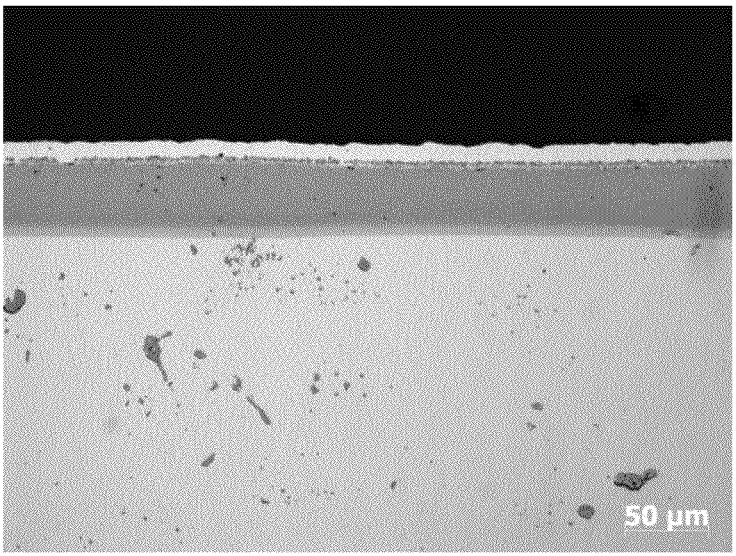
FIG. 16B is a micrograph of the surface layer of the experimental material after the heat treatment step at a temperature of 1,000° C. for one hour.
Figure 16C:
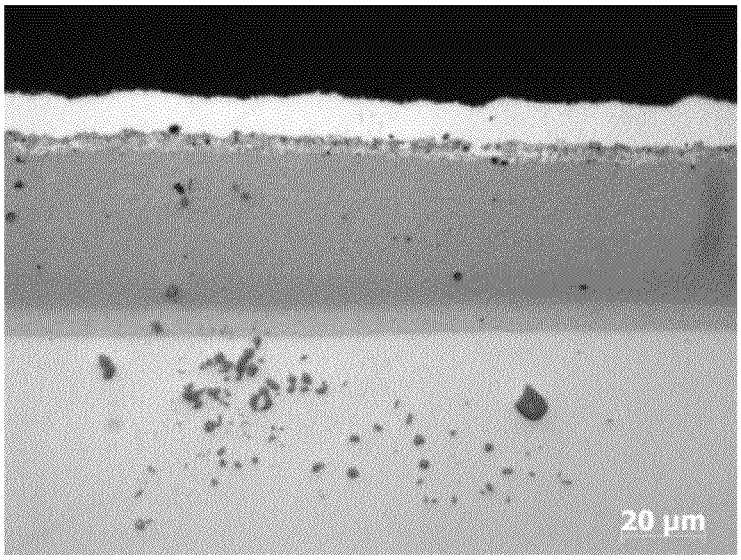
FIG. 16C is an enlarged photograph of FIG. 16B.
Figure 17A:
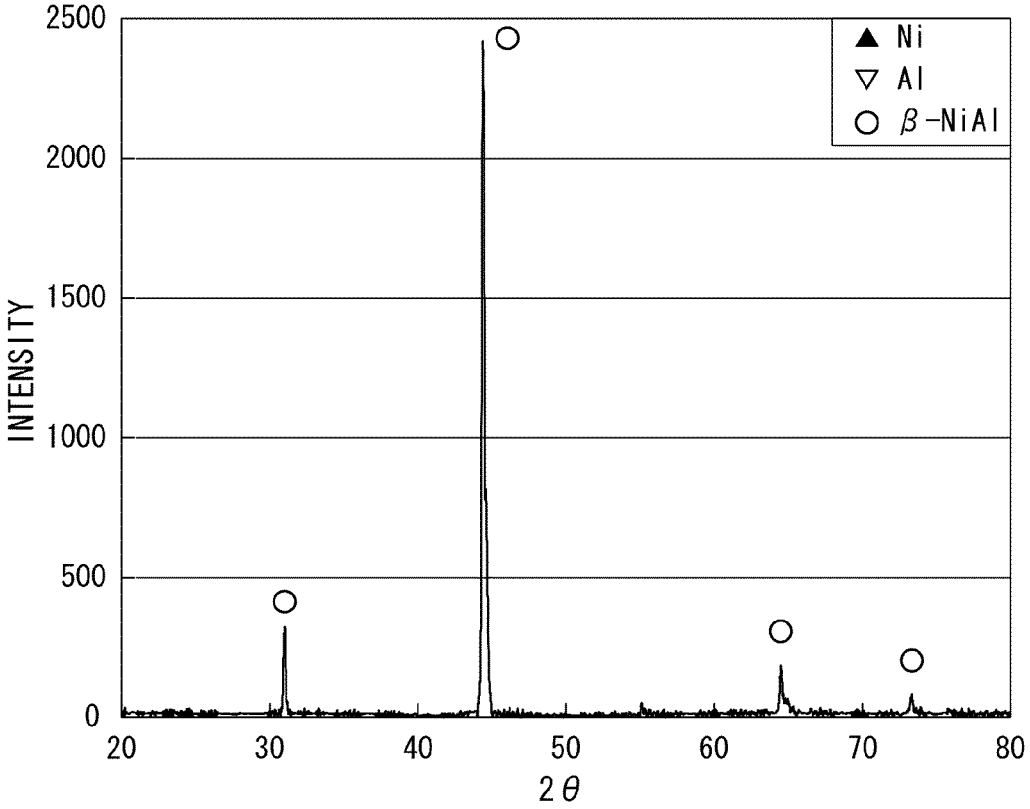
FIG. 17A is X-ray diffraction data of a surface layer of an experimental material after a heat treatment step at a temperature of 1,050° C. for one hour.
Figure 17B:
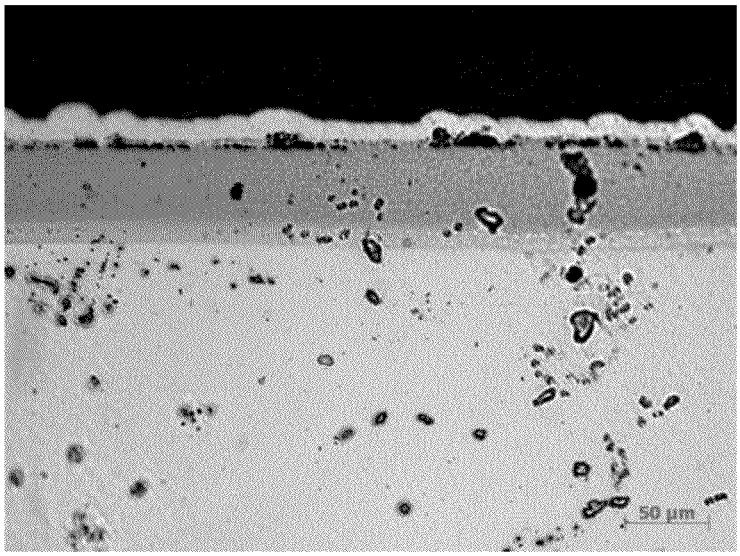
FIG. 17B is a micrograph of the surface layer of the experimental material after the heat treatment step at a temperature of 1,050° C. for one hour.
Figure 17C:
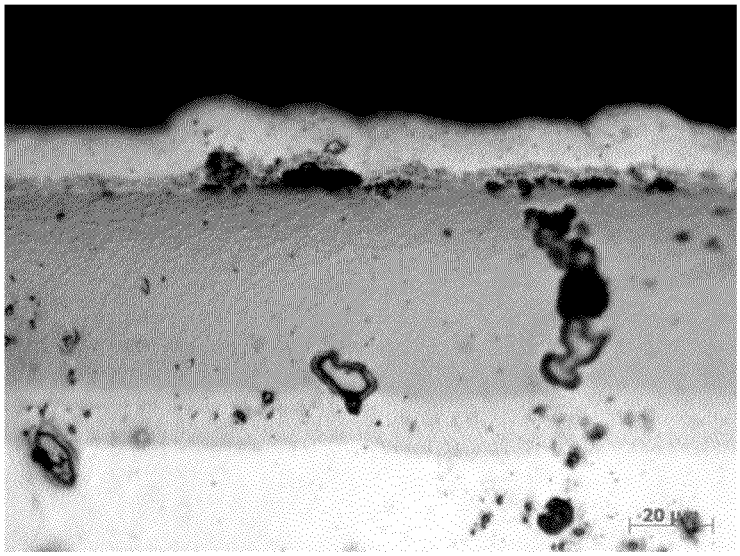
FIG. 17C is an enlarged photograph of FIG. 17B.
Figure 18A:
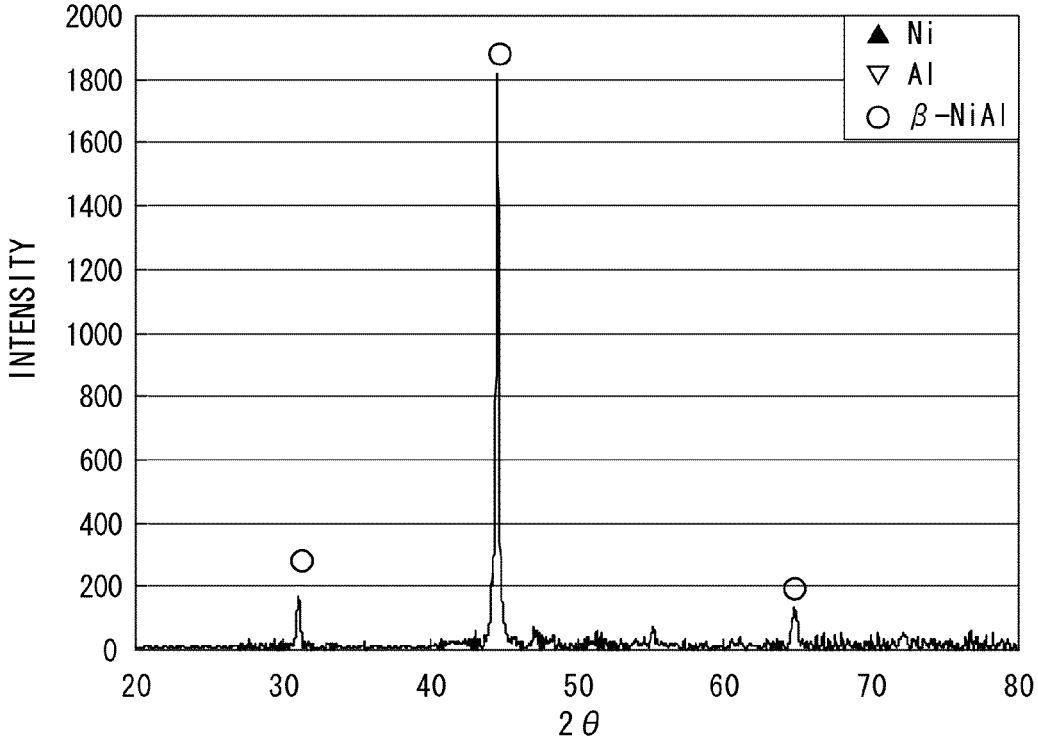
FIG. 18A is X-ray diffraction data of a surface layer of an experimental material after a heat treatment step at a temperature of 1,080° C. for 4.5 hours.
Figure 18B:
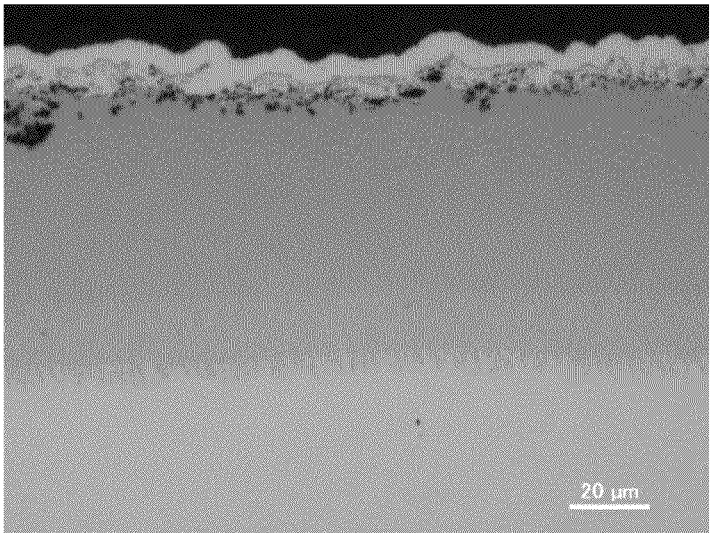
FIG. 18B is a micrograph of the surface layer of the experimental material after the heat treatment step at a temperature of 1,080° C. for 4.5 hours.

FIGS. 16A to 16E show experimental data in a case where the treatment temperature and the treatment time in the heat treatment step S2 were set to 1000° C. and one hour, respectively. FIGS. 17A to 17C show experimental data in a case where the treatment temperature and the treatment time in the heat treatment step S2 were set to 1050° C. and one hour, respectively. FIGS. 18A and 18B show experimental data in a case where the treatment temperature and the treatment time in the heat treatment step S2 were set to 1080° C. and 4.5 hours, respectively. FIGS. 19A to 19E show experimental data in a case where the treatment temperature and the treatment time in the heat treatment step S2 were set to 1100° C. and one hour, respectively.

FIGS. 16A, 17A, 18A, and 19A show X-ray diffraction data obtained by measuring the surface layer of the experimental material after the heat treatment step S2 using an X-ray diffractometer. The vertical axis represents the intensity of an X-ray and the horizontal axis represents an angle difference (2θ) between an incident direction and a diffraction direction of the X-ray. In addition, the vertical axis has no units and the unit of the horizontal axis is an angle (°).

Figure 19A:
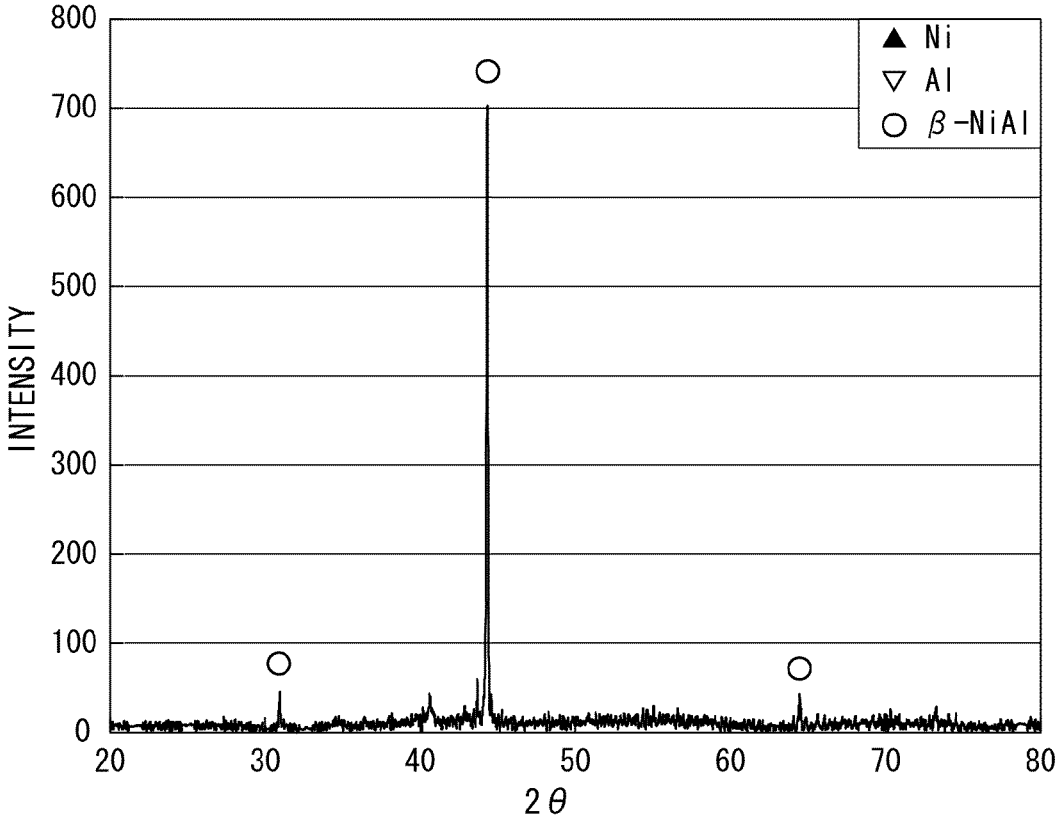
FIG. 19A is X-ray diffraction data of a surface layer of an experimental material after a heat treatment step at a temperature of 1,100° C. for one hour.
Figure 19B:
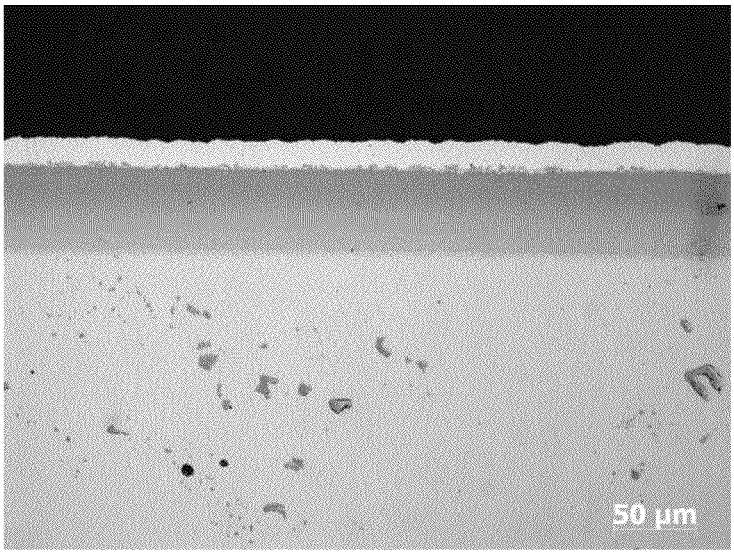
FIG. 19B is a micrograph of the surface layer of the experimental material after the heat treatment step at a temperature of 1,100° C. for one hour.
Figure 19C:
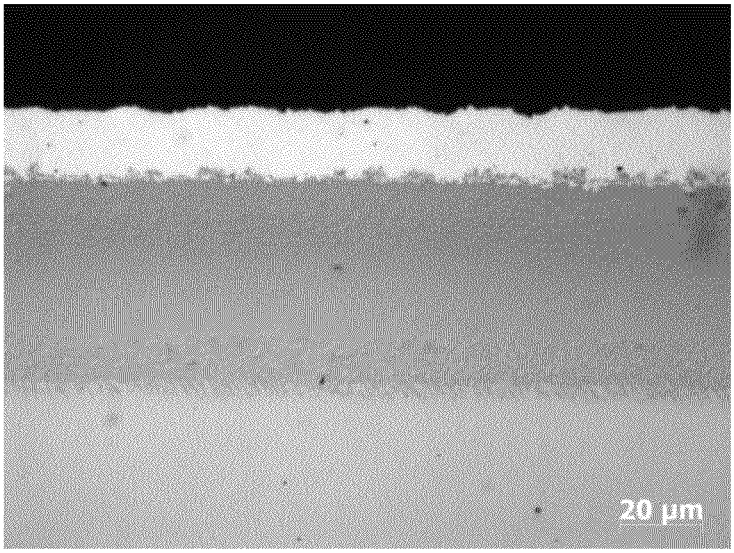
FIG. 19C is an enlarged photograph of FIG. 19B.

FIGS. 16B, 17B, 18B, and 19B show micrographs of the surface layer of the experimental material after the heat treatment step S2. In addition, FIGS. 16C, 17C, and 19C show enlarged photographs of FIGS. 16B, 17B, and 19B, respectively.

Figure 16D:
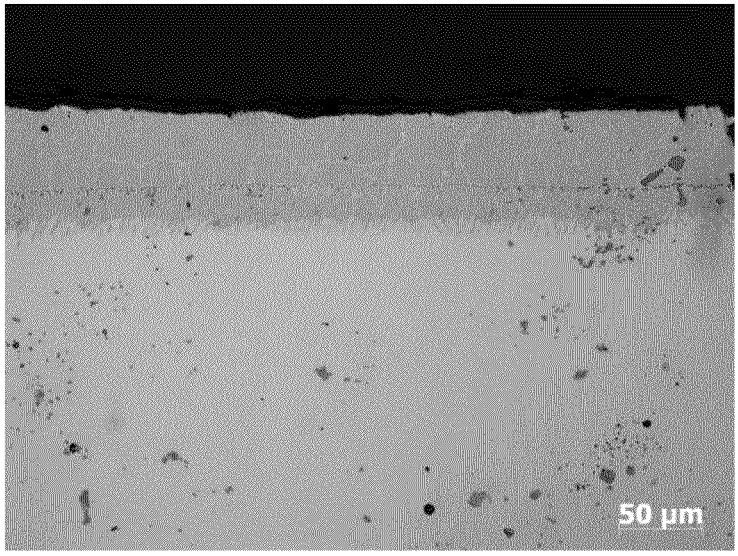
FIG. 16D is a micrograph of the surface layer of the experimental material after performing an oxidation experiment with respect to the experimental material to which the heat treatment step at a temperature of 1,000° C. for one hour has been performed.
Figure 16E:
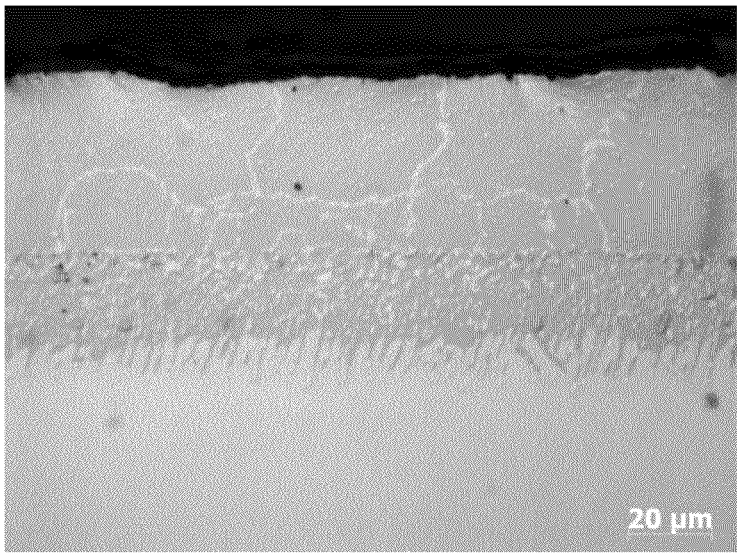
FIG. 16E is an enlarged photograph of FIG. 16D.
Figure 19D:
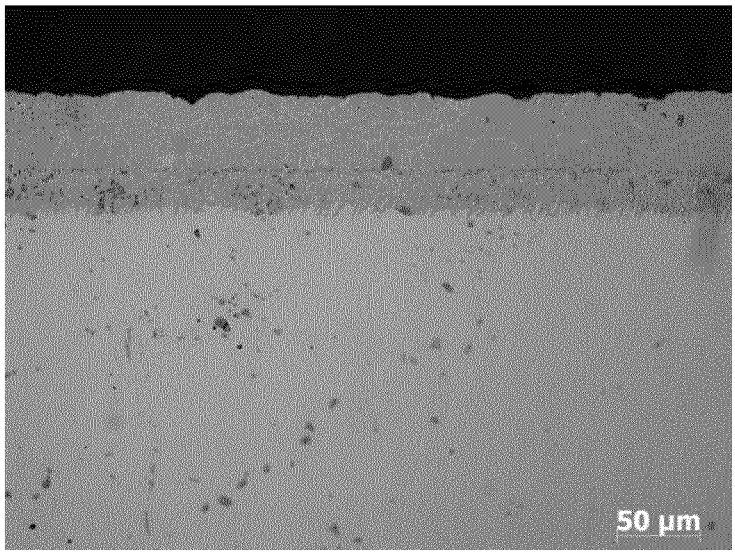
FIG. 19D is a micrograph of the surface layer of the experimental material after performing an oxidation experiment with respect to the experimental material to which the heat treatment step at a temperature of 1,100° C. for one hour has been performed.
Figure 19E:
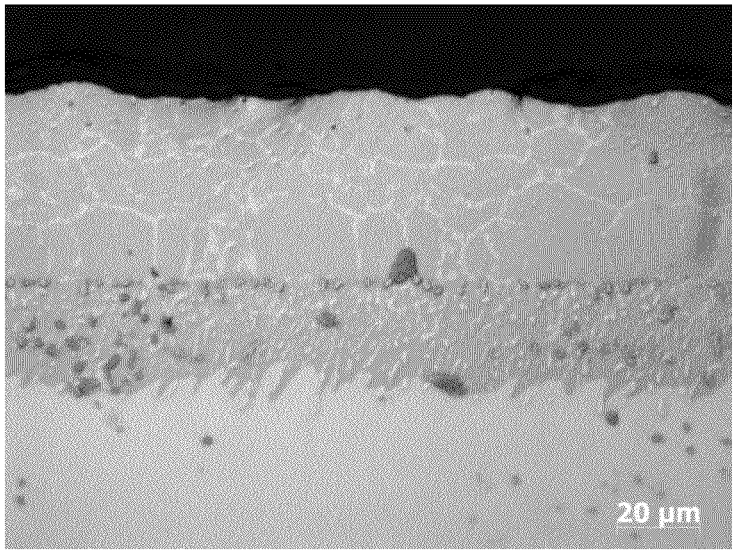
FIG. 19E is an enlarged photograph of FIG. 19D.

FIGS. 16D and 19D show micrographs of the surface layer of the experimental material after disposing the experimental material after the heat treatment step S2 in an oxygen atmosphere and carrying out an oxidation experiment of heating the experimental material at 1121° C. for 23 hours. In addition, FIGS. 16E and 19E are enlarged photographs of FIGS. 16D and 19D, respectively.

As shown in FIGS. 16A, 17A, 18A, and 19A, when the heat treatment was carried out after forming the aluminum plated layer on the surface of the experimental material (Rene 142), it was confirmed that the β-NiAl phase was formed in the surface layer of the experimental material. This result is the same as that of Experimental Example 1, and when the heat treatment was carried out at a temperature of 1,000° C. or more, the β-NiAl phase having excellent oxidation resistant performance was formed in the surface layer of the experimental material.

In addition, as shown in FIG. 18B, even when the experimental material was heated at a temperature of 1,000° C. or more for 4.5 hours, problems such as cracking did not occur in the oxidation resistant layer of the experimental material.

As shown in FIGS. 16D, 16E, 19D, and 19E, even when the oxidation experiment was carried out with respect to the experimental material (the experimental material was disposed in an oxygen atmosphere and then was heated at 1121° C. for 23 hours) after the heat treatment step S2, chipping, peeling-off or the like did not occur in the surface layer of the experimental material, and transmutation or the like did not occur at the inside of the experimental material. That is, the surface layer of the experimental material exhibited satisfactory oxidation resistance.

In addition, the heat treatment step S2 in Experimental Example 3 was carried out in a vacuum atmosphere, but the heat treatment step S2 may be carried out, for example, in a hydrogen atmosphere ($H_2$) or an argon atmosphere (Ar). Even when the heat treatment step S2 was carried out in this atmosphere, it was confirmed that the oxidation resistant coating layer was formed similarly to a case in which the heat treatment step S2 was carried out in the vacuum atmosphere.

In addition, the electrolytic solution 4 (refer to FIG. 3) that was used in the plating treatment step S1 was a solution that was obtained by mixing dimethylsulfone as a non-aqueous solvent and aluminum chloride as a solute in a molar ratio of 10:1 to 10:3 as described above. Trimethylamine hydrochloride ($(CH_3)_3N.HCl$) or dimethylamine hydrochloride ($(CH_3)_2N.HCl$) may be added to the electrolytic solution 4. The addition ratio is preferably set to a ratio of 0.02 to 0.4 moles of trimethylamine hydrochloride or dimethylamine hydrochloride with respect to 10 moles of dimethylsulfone. When the trimethylamine hydrochloride or dimethylamine hydrochloride was added to the electrolytic solution 4, it was confirmed that the oxidation resistant layer in the surface layer of the experimental material was formed more smoothly.

In addition, a first comparative example of Experimental Example 3 will be described with reference to FIG. 20A.

Figure 20A:
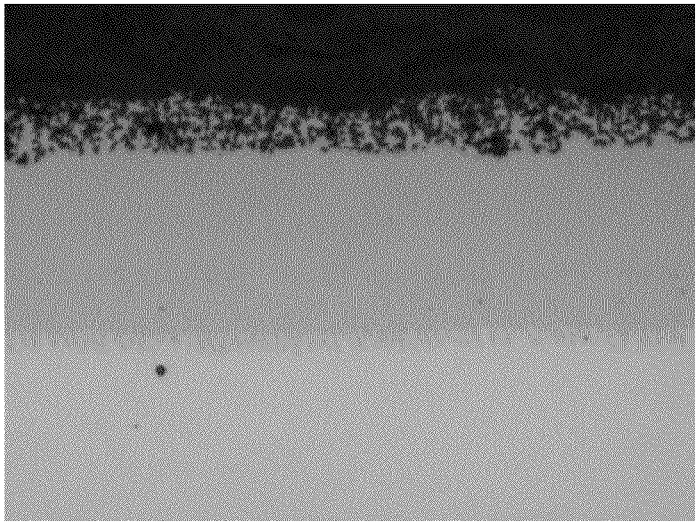
FIG. 20A is a micrograph of a surface layer of an experimental material after a heat treatment step in which heat treatment at 1080° C. for 4.5 hours is further performed after performing heat treatment at 640° C. for 10 hours.

FIG. 20A shows experimental data in a case where in the heat treatment process S2, heat treatment was carried out at 640° C. for 10 hours and then heat treatment was further carried out at 1080° C. for 4.5 hours. In addition, FIG. 20A shows a micrograph of the surface layer of the experimental material after the heat treatment step S2. The material of the experimental material and the plated layer, and the plating treatment conditions in the first comparative example were the same as the material and conditions in Experimental Example 3.

As shown in FIG. 20A, a porous layer was formed on the surface of the experimental material to which the heat treatment step S2 was carried out in the first comparative example. The occurrence of voids (pores) in the plated layer on the surface when being heated at 640° C. is considered to be a cause of the formation of the porous layer. On the other hand, in Experimental Example 3, since a porous layer was not formed on the surface of the experimental material, it is considered that a faster temperature increase rate to the treatment temperature in the heat treatment step S2 is preferable.

In addition, a second comparative example of Experimental Example 3 will be described with reference to FIGS. 20B and 20C.

Figure 20B:
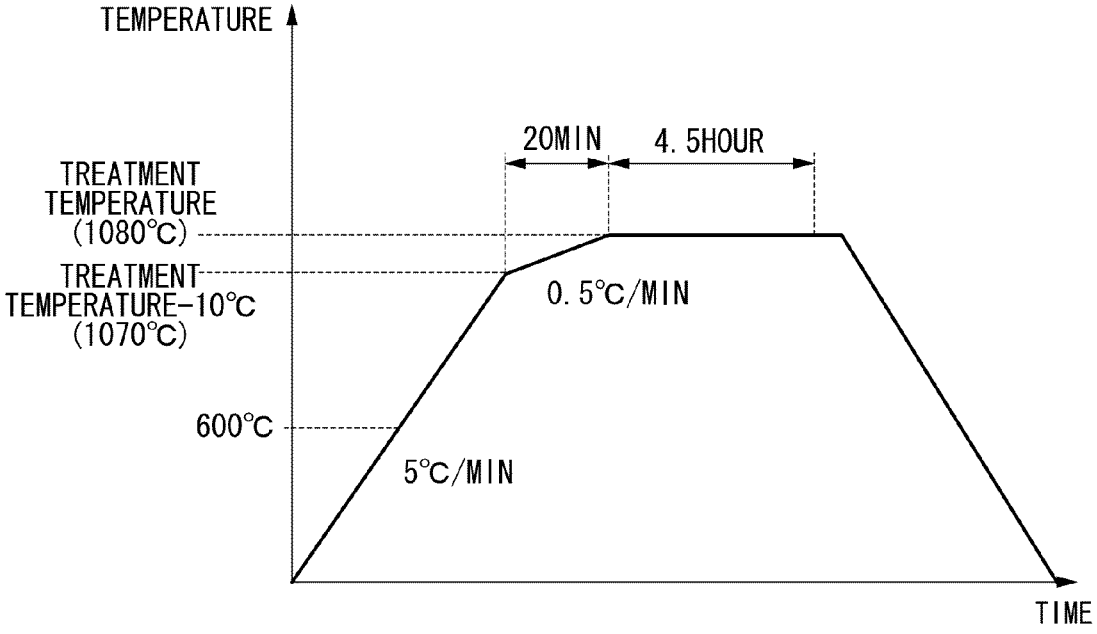
FIG. 20B is a schematic diagram illustrating other temperature increase conditions with respect to an experimental material.

FIG. 20B shows a schematic diagram illustrating temperature increase conditions different from that of Experiment Example 3. FIG. 20C shows a micrograph of the surface layer of the experimental material after heating the experimental material based on the temperature increase conditions shown in FIG. 20B and carrying out the heat treatment step S2 in which the treatment temperature and treatment time were set to 1080° C. and 4.5 hours, respectively. The material of the experimental material and the plated layer, and the plating treatment conditions in the second comparative example were the same as the material and conditions in Experimental Example 3.

In the second comparative example, the experimental material was heated to 1080° C. that is the treatment temperature based on the temperature increase conditions shown in FIG. 20B. That is, the experimental material was heated at a temperature increase rate of 5° C./min until the experimental material reached [treatment temperature −10° C. (=1070° C.)] from room temperature, and at a temperature increase rate of 0.5° C./min until the experimental material reached the treatment temperature from [treatment temperature −10° C.].

Figure 20C:
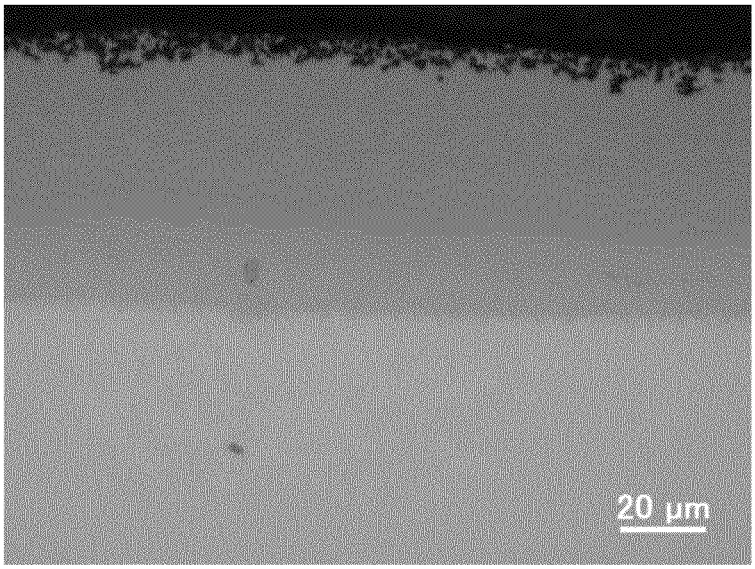
FIG. 20C is a micrograph of a surface layer of an experimental material after a heat treatment step at a temperature of 1,080° C. for 4.5 hours.

As shown in FIG. 20C, a porous layer was formed on the surface of the experimental material to which the heat treatment step S2 was carried out in the second comparative example. As a cause of the formation of the porous layer, it is considered that since the temperature increase rate to the treatment temperature was made slower than that in Experimental Example 3, voids occurred in the plated layer on the surface during temperature increase. Therefore, it is considered that the temperature increase rate to the treatment temperature in the heat treatment step S2 is preferably 5° C./min or more.

In addition, the temperature increase rate to the treatment temperature is preferably 15° C./min or less so as to prevent peeling-off, floating, and the like of the plated layer that is caused by a decrease in adhesiveness between the experimental material and the plated layer due to thermal shock of the temperature increase (particularly, at the time of heating-initiation). Furthermore, it is preferable that the experimental material is heated at a temperature increase rate of 1° C./min or less until the experimental material reaches the treatment temperature from [treatment temperature −10° C.] so as to prevent the temperature of the experimental material from exceeding the treatment temperature (overshoot). Consequently, the experimental material is preferably heated at a temperature increase rate of 5° C./min or more and 15° C./min or less until the experimental reaches 600° C. from room temperature, at a temperature increase rate of 5° C./min or more until the experimental material reaches [treatment temperature −10° C.] from 600° C., and at a temperature increase rate of 1° C./min or less until the experimental material reaches the treatment temperature from [treatment temperature −10° C.].

Experimental Example 4

A fourth experimental example will be described with reference to FIGS. 21A to 22B.

As the experimental material, a pure titanium plate was used. The plating treatment step S1 and the heat treatment step S2 were sequentially carried out with respect to the experimental material. The electrolytic solution 4 (refer to FIG. 3) that was used in the plating treatment step S1 was a solution obtained by mixing dimethylsulfone ($(CH_3)_2SO_2$), aluminum chloride ($AlCl_3$), and trimethylamine hydrochloride ($(CH_3)_3NHCl$) in a molar ratio of 10:2:0.1. In the plating treatment step S1, an aluminum plated layer having a thickness of about 30 μm was formed on the surface of the experimental material. In the heat treatment step S2, heat treatment was carried out in an argon atmosphere (Ar).

Figure 21A:
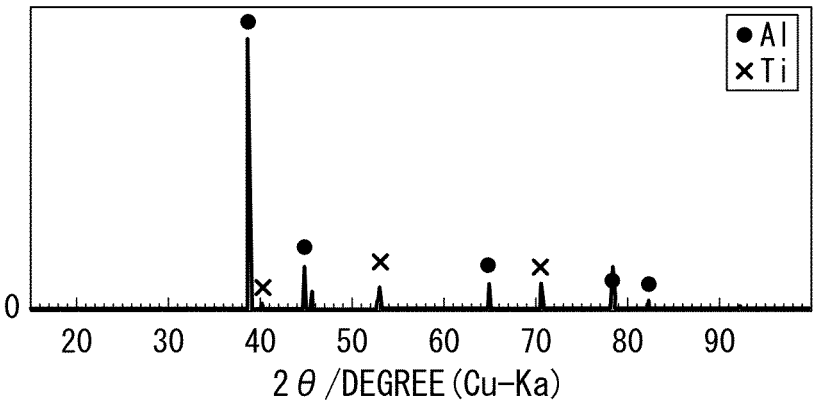
FIG. 21A is X-ray diffraction data of a surface layer of a titanium plate to which only plating treatment is performed.
Figure 21B:
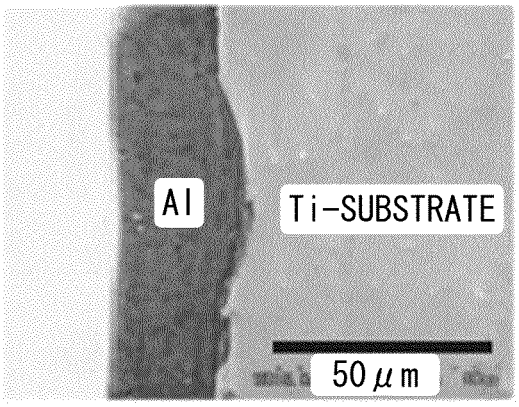
FIG. 21B is a micrograph of the surface layer of the titanium plate to which only plating treatment is performed.
Figure 22A:
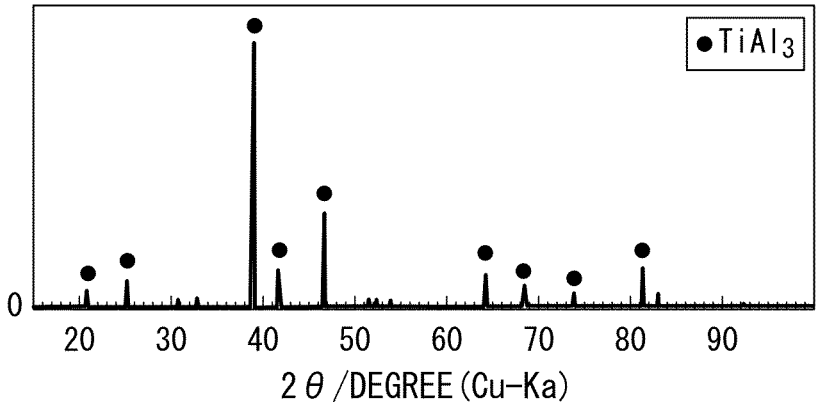
FIG. 22A is X-ray diffraction data of a surface layer of a titanium plate to which heat treatment is performed at a temperature of 700° C. for one hour after plating treatment.
Figure 22B:
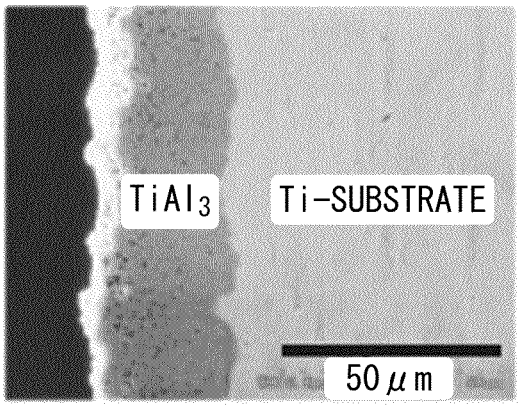
FIG. 22B is a micrograph of the surface layer of the titanium plate to which the heat treatment is performed at a temperature of 700° C. for one hour after the plating treatment.

FIGS. 21A and 21B show experimental data in a case where the only plating treatment step S1 was carried out with respect to the experimental material. FIGS. 22A and 22B show experimental data in a case where the plating treatment step S1 was carried out and then the heat treatment step S2 was carried out at 700° C. for one hour with respect to the experimental material.

FIGS. 21A and 22A show X-ray diffraction data obtained by measuring the surface layer of the experimental material using an X-ray diffractometer. The vertical axis represents the intensity of an X-ray and the horizontal axis represents an angle difference (2θ) between an incident direction and a diffraction direction of the X-ray. FIGS. 21B and 22B show micrographs of the surface layer of the experimental material.

As shown in FIG. 21A, when the aluminum plated layer was only formed on the pure titanium plate, the $TiAl_3$ phase having excellent oxidation resistant performance was not confirmed. On the other hand, as shown in FIG. 22A, when the heat treatment was carried out after forming the aluminum plated layer on the pure titanium plate, the $TiAl_3$ phase having excellent oxidation resistant performance was confirmed.

That is, it was confirmed that when the heat treatment step S2 was performed after the plating treatment step S1, the oxidation resistant coating layer was formed on the surface layer of the pure titanium plate.

Experimental Example 5

A fifth experimental example will be described with reference to FIGS. 23A to 25.

As the experimental material, a titanium-aluminum plate (TiAl) was used. With respect to the experimental material, the plating treatment step S1 and the heat treatment step S2 were sequentially carried out. Conditions of the plating treatment step S1 were the same as that of Experimental Example 4. In the heat treatment step S2, heat treatment was carried out in an argon atmosphere (Ar).

Figure 23A:
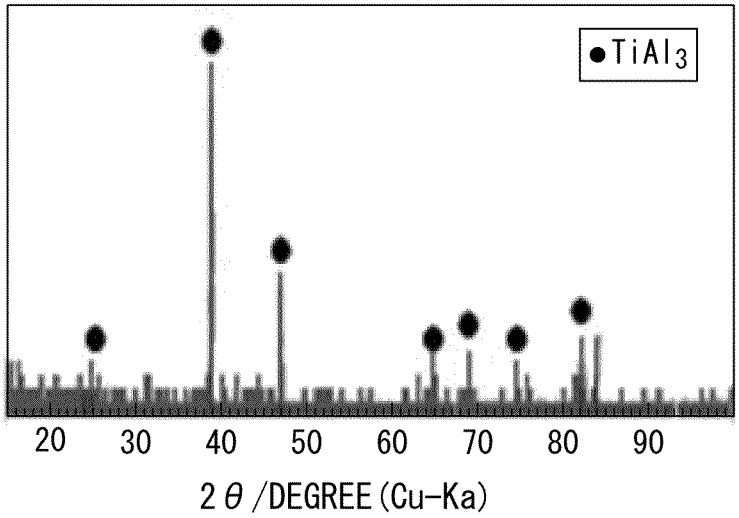
FIG. 23A is X-ray diffraction data of a surface layer of a titanium-aluminum plate after a heat treatment step at a temperature of 700° C. for one hour.
Figure 23B:
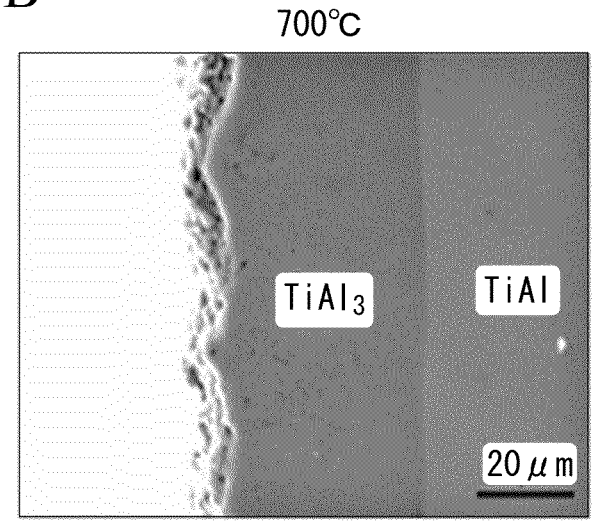
FIG. 23B is a micrograph of the surface layer of the titanium-aluminum plate after the heat treatment step at a temperature of 700° C. for one hour.
Figure 24:
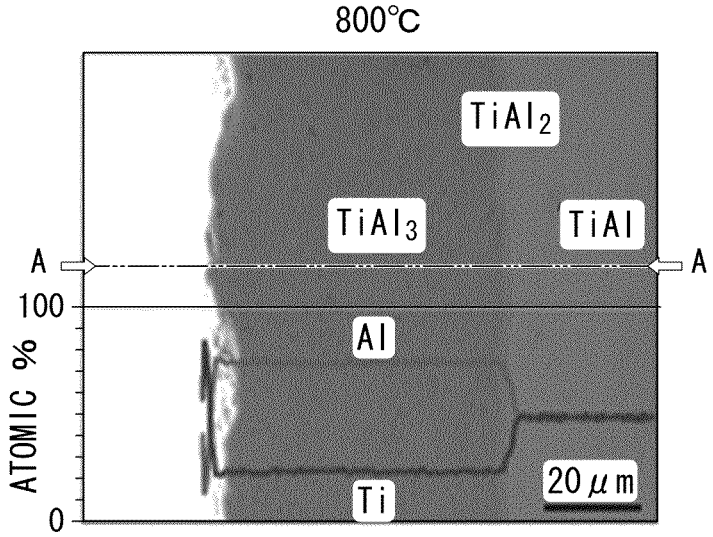
FIG. 24 is a micrograph of a surface layer of a titanium-aluminum plate after a heat treatment step at a temperature of 800° C. for one hour.
Figure 25:
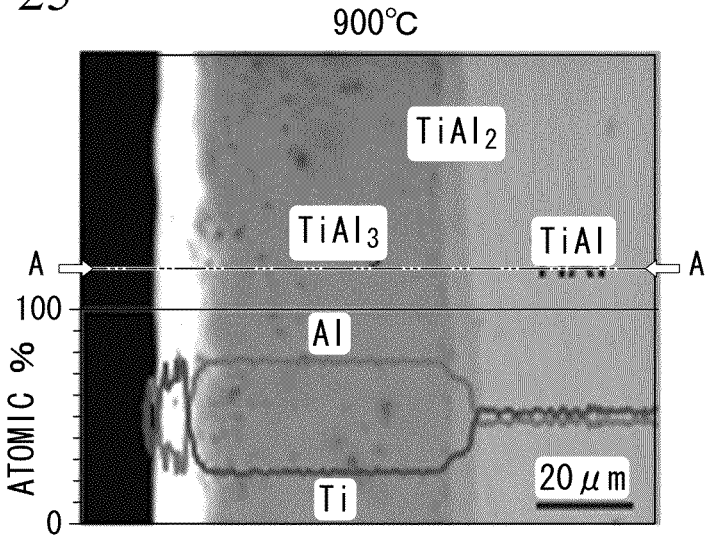
FIG. 25 is a micrograph of a surface layer of a titanium-aluminum plate after a heat treatment step at a temperature of 900° C. for one hour.

FIGS. 23A and 23B show experimental data in a case where the treatment temperature and the treatment time in the heat treatment step S2 were set to 700° C. and one hour, respectively. FIG. 24 show experimental data in a case where the treatment temperature and the treatment time in the heat treatment step S2 were set to 800° C. and one hour, respectively. FIG. 25 show experimental data in a case where the treatment temperature and the treatment time in the heat treatment step S2 were set to 900° C. and one hour, respectively.

FIG. 23A shows X-ray diffraction data obtained by measuring the surface layer of the experimental material using an X-ray diffractometer. The vertical axis represents the intensity of an X-ray and the horizontal axis represents an angle difference (2θ) between an incident direction and a diffraction direction of the X-ray. FIGS. 23B, 24, and 25 show micrographs of the surface layer of the experimental material. In addition, in the lower side of FIGS. 24 and 25, compositional ratio in the surface layer of the experimental material is described together. This compositional ratio was obtained by performing measurement on a line A-A in FIGS. 24 and 25 using EPMA (electron probe microanalyzer).

As shown in FIGS. 23A, 24, and 25, when the heat treatment was carried out after forming an aluminum plated layer on the titanium-aluminum plate (TiAl), a $TiAl_3$ phase having excellent oxidation resistant performance was confirmed.

That is, when the heat treatment step S2 was carried out after the plating treatment step S1, it was confirmed that the oxidation resistant coating layer was formed on the surface layer of the titanium-aluminum plate.

Experimental Example 6

A sixth experimental example will be described with reference to FIGS. 26A to 28B.

As the experimental material, a titanium-aluminum plate (TiAl) was used. With respect to the experimental material, the plating treatment step S1 and the heat treatment step S2 were sequentially carried out. Conditions of the plating treatment step S1 were the same as that of Experimental Example 4. In the heat treatment step S2, heat treatment was carried out in a vacuum atmosphere.

Figure 26A:
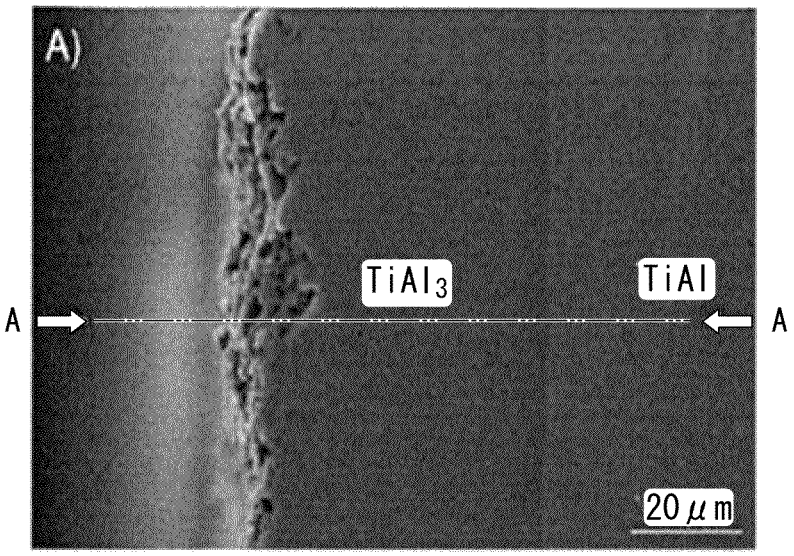
FIG. 26A is a micrograph of a surface layer of a titanium-aluminum plate after a heat treatment step at a temperature of 650° C. for one hour.
Figure 26B:
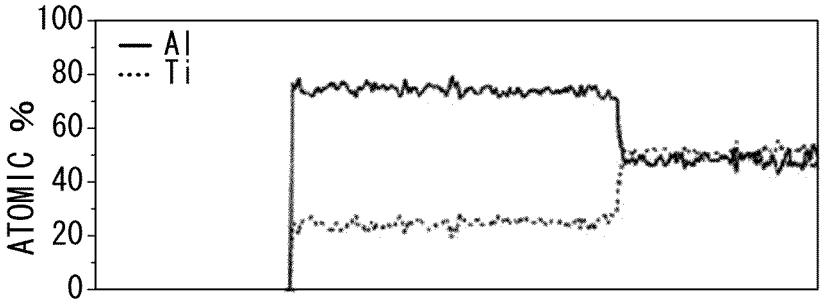
FIG. 26B is data representing a composition ratio of the surface layer of the titanium-aluminum plate after the heat treatment step at a temperature of 650° C. for one hour.
Figure 27A:
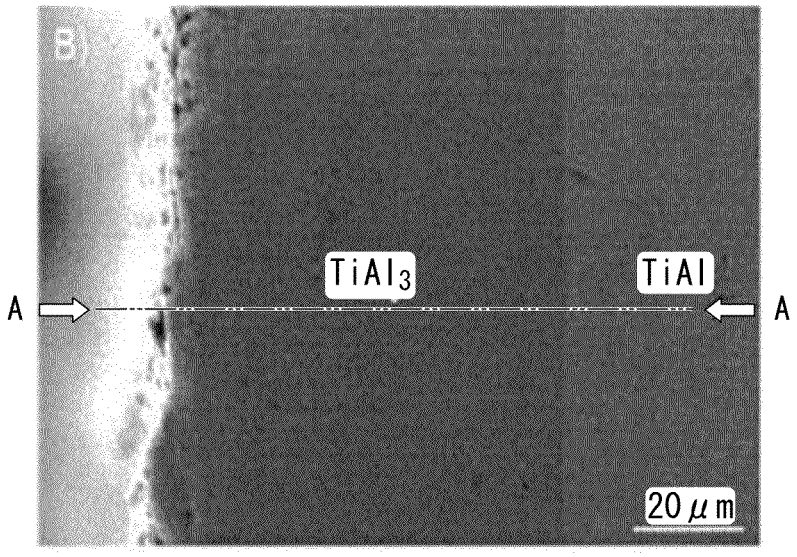
FIG. 27A is a micrograph of a surface layer of a titanium-aluminum plate after a heat treatment step at a temperature of 700° C. for one hour.
Figure 27B:
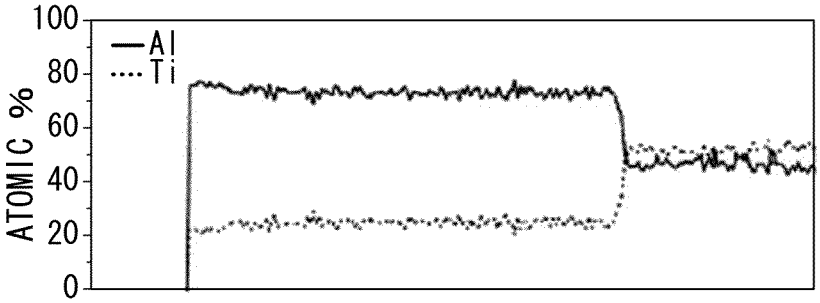
FIG. 27B is data representing a composition ratio of the surface layer of the titanium-aluminum plate after the heat treatment step at a temperature of 700° C. for one hour.
Figure 28A:
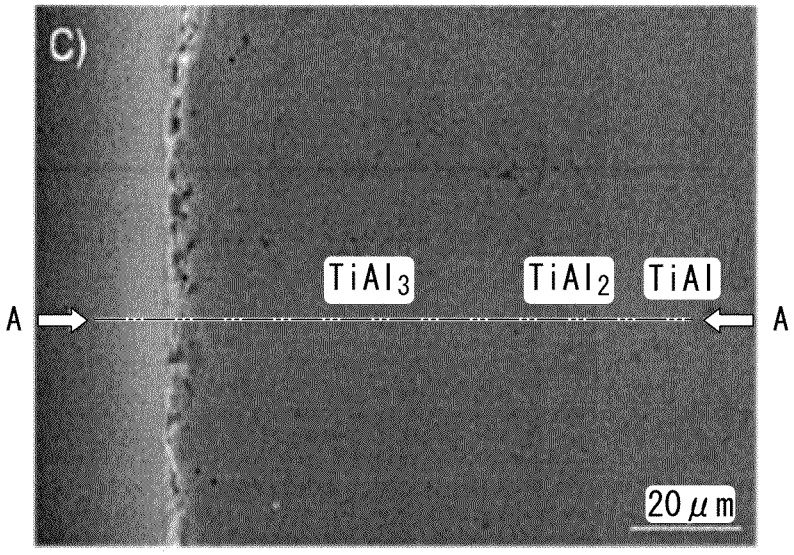
FIG. 28A is a micrograph of a surface layer of a titanium-aluminum plate after a heat treatment step at a temperature of 1,000° C. for one hour.
Figure 28B:
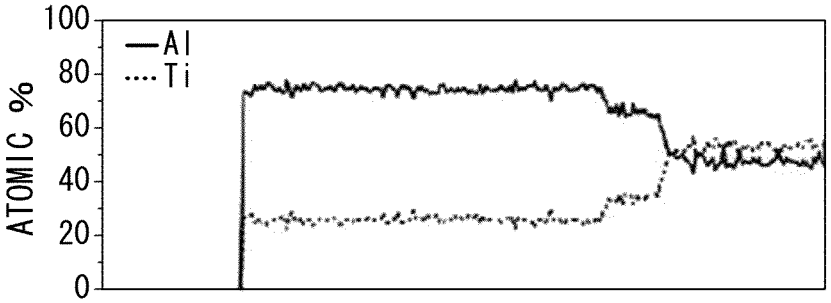
FIG. 28B is data representing a composition ratio of the surface layer of the titanium-aluminum plate after the heat treatment step at a temperature of 1,000° C. for one hour.

FIGS. 26A and 26B show experimental data in a case where the treatment temperature and the treatment time in the heat treatment step S2 were set to 650° C. and one hour, respectively. FIGS. 27A and 27B show experimental data in a case where the treatment temperature and the treatment time in the heat treatment step S2 were set to 700° C. and one hour, respectively. FIGS. 28A and 28B show experimental data in a case where the treatment temperature and the treatment time in the heat treatment step S2 were set to 1,000° C. and one hour, respectively.

FIGS. 26A, 27A, and 28A show electron micrographs of the surface layer of the experimental material. FIGS. 26B, 27B, and 28B show compositional ratios in the surface layer of the experimental material. These compositional ratios were obtained by performing measurement on a line A-A in FIGS. 26A, 27A, and 28A using EPMA.

As shown in FIGS. 26B, 27B, and 28B, when the heat treatment was carried out after forming an aluminum plated layer on the titanium-aluminum plate (TiAl), a $TiAl_3$ phase having excellent oxidation resistant performance was confirmed.

That is, when the heat treatment step S2 was carried out after the plating treatment step S1, it was confirmed that the oxidation resistant coating layer was formed on the surface layer of the titanium-aluminum plate.

According to the method of forming the oxidation resistant coating layer of this embodiment as described above, the oxidation resistant coating layer can be formed on the surface layer of the turbine blade A formed of nickel-based alloy without using methods in the related art.

In addition, according to the method of forming the oxidation resistant coating layer of this embodiment, when dimethylsulfone having a melting point of 109° C. is used, the treatment temperature in the plating treatment step S1 can be lower than that in the plating treatment using molten salt or molten aluminum in the related art. Therefore, the oxidation resistant coating layer can be formed without using a high-temperature tank, and thus small-scaling and cost-down of a facility may be realized.

In addition, according to the method of forming the oxidation resistant coating layer of this embodiment, it is not necessary to use vapor phase chloride or fluoride that is difficult to treat, and thus safety in the treatment processes is improved. In addition, a large amount of auxiliary materials to control a high-temperature vapor phase reaction or a large-scaled apparatus are not necessary. In addition, since a continuous furnace can be used in the heat treatment step S2, the process can be continuously carried out.

In addition, according to the method of forming the oxidation resistant coating layer of this embodiment, aluminum can be adhered to the turbine blade A by dipping the turbine blade A in the electrolytic solution 4 in the plating treatment step S1. Therefore, it is not necessary to change the position of the turbine blade A during forming a film such as by sputtering or thermal spraying. In addition, even when the turbine blade A has a complicated shape, a uniform and thin oxidation resistant coating can be formed on the entire surface of the turbine blade A.

In addition, according to the method of forming the oxidation resistant coating layer of this embodiment, the film forming rate can be faster than the film forming rate of aluminum alloy using sputtering in the related art, and thus the oxidation resistant coating layer can be formed within a short time.

Hereinbefore, a preferred embodiment of the present invention was described with reference to the attached drawings, but the invention is not limited to the above-described embodiment. A shape or a combination of each constituent member indicated in the above-described embodiment is illustrative only, and various modifications are possible based on a design request or the like within the scope not departing from the gist of the present invention.

For example, in the above-described embodiment, a description was made with respect to a configuration that the member on which the oxidation resistant coating layer of the present invention is formed is the turbine blade formed of nickel-based alloy.

However, the invention is applicable to a case in which the oxidation resistant coating layer is formed with respect to a member formed of metallic material (for example, titanium, cobalt, or iron).

For example, the invention is applicable to a case in which the oxidation resistant coating layer is formed with respect to a turbine blade formed of titanium, titanium-based alloy, or nickel, a case in which the oxidation resistant coating layer is formed with respect to a jet nozzle formed of titanium, titanium-based alloy, nickel, or nickel-based alloy, and the like. In addition, the member on which the oxidation resistant coating layer is formed may be a material that partially includes the above metallic material (for example, nickel, nickel-based alloy, titanium, or titanium-based alloy).

In addition, in the above-described embodiment, a description was made with respect to a configuration in which, in the plating treatment step S1, dimethylsulfone that is a non-aqueous solvent is used as the solvent of the invention.

However, other solvents such as diethylsulfone ($(C_2H_5)_2SO_2$) and ionic liquid (for example, 1-aryl-3-alkylimidazolium-based ionic liquid) that are non-aqueous solvents may be used as the solvent of the invention.

However, it is preferable to use dimethylsulfone as the solvent of the invention when considering such things as a melting point is 109° C. and thus operation can be carried out at a relatively low temperature, a vapor pressure of a corrosive $AlCl_3$ that is an aluminum source becomes low, a plated layer is deposited smoothly, the cost is low, the film forming rate is fast, and an explosive material is not used.

DESCRIPTION OF REFERENCE SIGNS

A: Turbine blade (member)
S1: Plating treatment step
S2: Heat treatment step

The invention claimed is:

1. A method of forming an oxidation resistant coating layer containing aluminum on a surface layer of a member formed of metallic material, the method comprising:

a plating treatment step of plating aluminum on a surface of the member in a solvent; and a heat treatment step of heat-treating the member whose surface has been plated by the plating treatment step, wherein the member contains nickel or nickel-based alloy, in the heat treatment step, a treatment temperature of a heat treatment is 700° C. or more, and an $Al_3Ni_2$ phase or β-NiAl phase is formed in the surface layer of the member by diffusing the aluminum into the surface layer of the member through the heat treatment, and in the heat treatment step, the member is heated at a first temperature increase rate of 5° C./min or more and 15° C./min or less until the member reaches 600° C. from room temperature, at a second temperature increase rate of 5° C./min or more until the member reaches from 600° C., a temperature calculated by subtracting 10° C. from the treatment temperature, and at a third temperature increase rate of 1° C./min or less until the member reaches the treatment temperature from the temperature calculated by subtracting 10° C. from the treatment temperature.

2. The method of forming an oxidation resistant coating layer according to claim 1, wherein the plating treatment step includes electroplating treatment using dimethylsulfone as the solvent.

3. The method of forming an oxidation resistant coating layer according to claim 1, wherein a temperature of a heat treatment in the heat treatment step is 1000° C. or higher.

4. The method of forming an oxidation resistant coating layer according to claim 1, wherein in the heat treatment step, the treatment temperature of the heat treatment is 1000° C. or more, and a β-NiAl phase is formed in the surface layer of the member by diffusing the aluminum into the surface layer of the member through the heat treatment.

* * * * *